US011383154B2

(12) United States Patent
Irwin, Jr.

(10) Patent No.: US 11,383,154 B2
(45) Date of Patent: Jul. 12, 2022

(54) ENHANCED SECURITY INSTANT TICKETS VIA HOMOGENEOUS UTILIZATION OF THE BACKING FOR VARIABLE INDICIA INKS OR DYES

(71) Applicant: HYDRAGRAPHIX LLC, Providence, RI (US)

(72) Inventor: Kenneth Earl Irwin, Jr., Dawsonville, GA (US)

(73) Assignee: Hydragraphix LLC, Providence, RI (US)

( * ) Notice: Subject to any disclaimer, the term of this patent is extended or adjusted under 35 U.S.C. 154(b) by 0 days.

(21) Appl. No.: 17/365,021

(22) Filed: Jul. 1, 2021

(65) Prior Publication Data

US 2021/0322863 A1 Oct. 21, 2021

Related U.S. Application Data

(63) Continuation-in-part of application No. 16/249,572, filed on Jan. 16, 2019, which is a continuation of (Continued)

(51) Int. Cl.
*A63F 3/06* (2006.01)
*B42D 25/27* (2014.01)

(Continued)

(52) U.S. Cl.
CPC ..... *A63F 3/0665* (2013.01); *A63F 3/065* (2013.01); *A63F 3/0655* (2013.01); *B41J 2/01* (2013.01);

(Continued)

(58) Field of Classification Search
CPC ..... A63F 3/065; A63F 3/0665; A63F 3/0655; A63F 2003/066
See application file for complete search history.

(56) References Cited

U.S. PATENT DOCUMENTS 4,241,942 A 12/1980 Bachman
4,540,628 A 9/1985 Oberdeck et al.

(Continued)

FOREIGN PATENT DOCUMENTS

CA 2015351 A1 10/1991
CA 2079553 A1 3/1994

(Continued)

OTHER PUBLICATIONS

Inkpal www.inkpal.com/ink-news/what-is-the-difference-between-dye-and-pigment-ink/ (Year: 2012).*

(Continued)

*Primary Examiner* — Kyle R Grabowski
(74) *Attorney, Agent, or Firm* — Neal, Gerber & Eisenberg LLP

(57) ABSTRACT

A security-enhanced document including a substrate, variable indica applied to an area of a first side of the substrate, a scratch-off-coating applied over the variable indicia to maintain the variable indicia unreadable until the scratch-off-coating is removed by being scratched off, and digital imaging applied to an area of a reverse side of the substrate from the variable indicia, wherein the digital imaging applied to the area of the reverse side of the substrate includes the same materials as the variable indicia, is uniformly spread over the area of the reverse side of the substrate, and such that the digital imaging overlaps at least 50% of the variable indica applied to the area of the first side of the substrate, such that the variable indicia exhibits an insufficient signal-to-noise ratio relative to the signal-to-noise ratio of the digital imaging on the reverse side of the substrate so that the variable indicia cannot be discerned so long as the scratch-off-coating remains intact.

17 Claims, 15 Drawing Sheets

Related U.S. Application Data application No. 15/189,483, filed on Jun. 22, 2016, now Pat. No. 10,183,213.

(60) Provisional application No. 62/286,713, filed on Jan. 25, 2016.

(51) Int. Cl.

| | |
|---|---|
| ***B41M 3/00*** | (2006.01) |
| ***B42D 15/02*** | (2006.01) |
| ***B42D 25/20*** | (2014.01) |
| ***B41J 2/01*** | (2006.01) |
| ***B41J 2/32*** | (2006.01) |
| ***B41J 3/01*** | (2006.01) |
| ***G03G 15/00*** | (2006.01) |

(52) U.S. Cl.

CPC . *B41J 2/32* (2013.01); *B41J 3/01* (2013.01); *B41M 3/005* (2013.01); *B42D 15/025* (2013.01); *B42D 25/27* (2014.10); *B42D 25/285* (2014.10); *G03G 15/00* (2013.01); *A63F 2003/066* (2013.01); *A63F 2250/58* (2013.01)

(56) References Cited

U.S. PATENT DOCUMENTS

| | | | | |
|---|---|---|---|---|
| 4,586,711 | A | 5/1986 | Winters et al. | |
| 5,213,664 | A * | 5/1993 | Hansell | D21H 21/40 162/134 |
| 5,414,262 | A | 5/1995 | Filo | |
| 5,431,452 | A | 7/1995 | Chang et al. | |
| 5,542,710 | A | 8/1996 | Silverschotz et al. | |
| 5,569,142 | A | 10/1996 | Snellman | |
| 5,569,512 | A | 10/1996 | Brawner et al. | |
| 5,704,647 | A | 1/1998 | Desbiens | |
| 5,740,514 | A | 4/1998 | Natsudaira | |
| 5,772,510 | A | 6/1998 | Roberts | |
| 5,803,504 | A | 9/1998 | Desbiens et al. | |
| 6,155,491 | A | 12/2000 | Dueker et al. | |
| 6,916,047 | B2 | 7/2005 | Jarvis et al. | |
| 6,939,627 | B2 | 9/2005 | Morizumi et al. | |
| 7,311,599 | B2 | 12/2007 | Knapp | |
| 7,322,529 | B2 | 1/2008 | Behm et al. | |
| 7,377,512 | B2 | 5/2008 | Brickwood et al. | |
| 7,455,323 | B2 | 11/2008 | Taylor et al. | |
| 7,472,926 | B2 | 1/2009 | Friesen et al. | |
| 7,562,626 | B2 | 7/2009 | Morizumi et al. | |
| 7,665,732 | B2 | 2/2010 | Stephens | |
| 7,712,741 | B2 | 5/2010 | Lambert | |
| 7,720,421 | B2 * | 5/2010 | Snyder | G03G 15/6573 399/321 |
| 8,074,570 | B2 | 12/2011 | Grotkowski et al. | |
| 8,342,576 | B2 | 1/2013 | Eschbach et al. | |
| 8,366,153 | B2 | 2/2013 | Martineck | |
| 8,883,390 | B1 | 11/2014 | Tyagi et al. | |
| 10,147,283 | B2 | 12/2018 | Weil et al. | |
| 10,185,522 | B2 | 1/2019 | Irwin et al. | |
| 10,543,712 | B2 | 1/2020 | Behm et al. | |
| 2006/0081710 | A1 | 4/2006 | Streeter | |
| 2006/0165997 | A1 | 7/2006 | Tevis et al. | |
| 2007/0164559 | A1 | 7/2007 | Kozdras | |
| 2007/0281224 | A1 | 12/2007 | Kirk et al. | |
| 2008/0138641 | A1 | 6/2008 | Leenders et al. | |
| 2008/0197621 | A1 * | 8/2008 | Grotkowski | A63F 3/065 283/94 |
| 2009/0263583 | A1 * | 10/2009 | Mantell | A63F 3/0665 427/258 |
| 2010/0218693 | A1 | 9/2010 | Kozdras | |
| 2010/0253063 | A1 | 10/2010 | Skogster | |
| 2011/0001314 | A1 | 1/2011 | Eschbach et al. | |
| 2012/0025516 | A1 | 2/2012 | Miller et al. | |
| 2012/0267888 | A1 | 10/2012 | Behm et al. | |
| 2014/0356537 | A1 | 12/2014 | Tyagi et al. | |
| 2017/0236371 | A1 | 8/2017 | Froelich et al. | |

FOREIGN PATENT DOCUMENTS

| | | | |
|---|---|---|---|
| CA | 2359581 | A1 | 1/2002 |
| CA | 2421241 | A1 | 8/2003 |
| CN | 101883680 | A | 11/2010 |
| EP | 0608065 | A2 | 7/1994 |
| JP | 2001331770 | A | 11/2001 |
| WO | 9535216 | A1 | 12/1995 |
| WO | 2010130041 | A1 | 11/2010 |

OTHER PUBLICATIONS

"Extended European Search Report", European Patent Application No. 20 16 5567 (7 pages), dated Aug. 21, 2020.

"Inkpal: Dye Inks vs. Pigment Inks", http://www.inkpal.com/ink-news/what-is-the-difference-between-dye-and-pigment-ink/ (Year: 2012).

"Instant Lottery Ticket, Madehow.com", vol. 4, http://www.madehow.com/Volume-4/Instant-Lottery-Ticket.html (6 pages).

"International Preliminary Report on Patentability", PCT/US2017/014933 (41 pages), dated May 17, 2018.

"International Search Report and Written Opinion", PCT/US2017/014933 (12 pages), dated Apr. 7, 2017.

"Written Opinion", PCT/US2017/014933 (6 pages), dated Feb. 22, 2018.

"First Chinese Office Action", corresponding Chinese Patent Application No. 2017800197581, dated Aug. 23, 2021.

"First Chinese Office Action and Search Report—English Translation", corresponding Chinese Patent Application No. 2017800197581, dated Aug. 23, 2021.

* cited by examiner

ENHANCED SECURITY INSTANT TICKETS VIA HOMOGENEOUS UTILIZATION OF THE BACKING FOR VARIABLE INDICIA INKS OR DYES

PRIORITY CLAIM

This application is a continuation-in-part of, claims priority to, and the benefit of U.S. patent application Ser. No. 16/249,572, filed Jan. 16, 2019, which is a continuation of, claims priority to, and the benefit of U.S. patent application Ser. No. 15/189,483, filed Jun. 22, 2016, now U.S. Pat. No. 10,183,213, issued Jan. 22, 2019, which claims priority to and the benefit of U.S. Provisional Patent Application No. 62/286,713, filed Jan. 25, 2016, the entire contents of which are incorporated herein by reference.

BACKGROUND

The present disclosure relates generally to documents, such as lottery tickets, having variable indicia under a Scratch-Off-Coating (SOC), and more particularly to methods for enhancing the security of the documents while also adding to the aesthetics of the documents. Specifically, various embodiments of the present disclosure resolves the problem of securing variable indicia hidden under an intact SOC from various nefarious compromising methods (e.g., chemical diffusion, fluorescence, etc.) applied to the opposite side of the substrate from the variable indicia to determine the identity of the variable indicia while the document appears to remain pristine.

Lottery scratch-off or instant games have become a time-honored method of raising revenue for state and federal governments the world over. Indeed, the concept of hiding variable indicia information under a SOC has also been applied to numerous other products such as commercial contests, telephone card account numbers, gift cards, etc. Lottery game variable indicia are the letters, numbers, images, or other indicia which determine whether a ticket is a winner typically by identically matching two or more of the same letters, numbers, images, or other symbols that are part of the variable indicia under the SOC. Literally, billions of scratch-off products are printed every year where the SOCs are used to ensure that the product has not been previously used, played, or modified.

The variable indicia are often printed using a specialized high-speed ink jet with a water-soluble dye imaged on top of fixed plate or cylinder printed (e.g., flexographic, gravure, etc.) security layers that provide lower layer opacity, chemical barriers, and a higher contrast background for the ink jet variable indicia. The lower printed barriers therefore securing the variable indicia from compromise attacks originating through the back of the ticket or document. On top of the variable indicia there are printed a series of SOCs that include upper opacity and chemical barriers configured to provide countermeasures to compromise attacks originating on the same side of the ticket or document as the variable indicia. With both the upper and lower security ink film layers, the purpose is to ensure that the printed variable indicia cannot be read or decoded without first removing the associated SOC thereby ensuring that a game or product is secure against picking out winners or extracting confidential information from unsold tickets or documents.

However, there are known methods (e.g., wicking, vapor, steam, alcohol soaks, etc.) for diffusing the ink jet variable indicia either through the substrate backing or the front SOC. When carefully applied, these methods can temporally reveal the previously hidden variable indicia, thereby enabling illicit people to determine if a given ticket is a winner or non-winner while leaving little or no trace thereby selling only losing tickets or compromised documents to the public. The pick-out of variable indicia is ultimately made possible by a positive Signal-to-Noise (S/N) ratio of the diffused ink jet image through the substrate or the SOC relative to the ticket's background ink noise.

In addition to diffusion, techniques have been developed for inducing fluorescence in the ink jet variable indicia dye. In these fluorescence attacks the variable indicia dye is made to fluoresce with the ticket background not emitting any light or light in a different wavelength than the fluorescing variable indicia ink jet image. Since the variable indicia emits fluorescent light in a wavelength different from the excitation source and the ticket background, there is a relatively high S/N ratio established between the fluorescence emissions of the variable indicia and the background noise. This relatively high S/N ratio enables filtered (i.e., using a narrow band optical filter only allowing fluorescent wavelength light to pass) extended timed exposures with digital cameras that can successfully capture variable indicia images through an intact SOC or ticket backing that are not discernable by the human eye. This again enables illicit pick-out of winning tickets with only losing tickets being sold to an unsuspecting public.

Similar to the above diffusion and fluorescence techniques, electrostatic charges have also been applied to instant tickets with intact SOCs creating a differential charge in the hidden ink jet variable indicia. At this point, if an electrostatically sensitive powder (e.g., baby powder) is applied over the SOC or ticket backing, the powder will align in the two-dimensional shape of the (previously) hidden variable indicia yet again enabling the underlying variable indicia to be viewed even though the SOC remains pristine. When the charge is removed and the powder is brushed away, no indication remains that the ticket's integrity was compromised. The electrostatic attack is based on establishing a positive S/N ratio of the ink jet variable indicia's charge relative to the ticket's background ink noise.

All of these variable indicia compromise techniques have been mitigated to date with elaborate countermeasures meticulously developed in the instant ticket industry over decades. Most of these countermeasures rely on various printed (via a fixed plate or cylinder—i.e., non-variable) chemical barriers to resist the aforementioned attacks. The general concept being to secure the variable ink jet indicia image with barrier layers, thereby reducing the variable indicia's S/N ratio to near unity or below relative to the ticket's background unless the SOC has been removed (i.e., scratched off). However, these added barrier security layers have the disadvantage of added costs, reduced aesthetics, intermittent failures, laborious testing and verification, and potential susceptibility to new attack methodologies.

BRIEF SUMMARY

This disclosure relates to a security-enhanced document with a removable SOC, which may be an instant lottery ticket in certain embodiments. The document includes any manner of suitable substrate, with the variable indicia remaining unreadable via diffusion, fluorescence, or electrostatic attacks until the associated SOC layer is legitimately removed.

Various embodiments of the present disclosure relate to a security-enhanced document comprising a substrate, variable indicia, at least one other printed portion creating background noise, and a SOC layer applied over the variable indicia to maintain the variable indicia unreadable until the SOC is removed by being scratched off, the variable indicia comprising ink having a measurable Signal-to-Noise ratio relative to the background ink noise of the document's at least one other printed portion, such that the variable indicia are undiscernible with reference to the at least one other printed portion while the SOC remains intact. For the present disclosure, the measurable Signal-to-Noise can be determined, for instance, when subjected to diffusion, fluorescence, or electrostatic charges.

In various embodiments, the variable indicia and the at least one other printed portion are printed with a printing technique with inks selected from the group including ink jet printing (either dye or pigmented based), thermal transfer and/or xerography, phaser, or laser exposure. In various embodiments, the variable indicia and at least one other printed portion are printed with the same ink chemical composition and in certain embodiments using the same application technique.

In certain embodiments, the variable indicia are imaged using the same type of ink as the front display portion or area (i.e., decorative portion printed on the same side or plane as the variable indicia, but the display portion is not covered by the SOC) of the document providing a common printed foundation for both the display and variable indicia portions, thereby greatly reducing the variable indicia's S/N ratio relative to the ticket's display background from the perspective of the front side of the ticket or document so long as the SOC remains intact. Unlike prior art barrier chemistry countermeasures, this embodiment has the advantage of reducing the variable indicia's S/N ratio relative to the front of the document's display portion under virtually any circumstances, rather than only for specified attacks.

In certain embodiments, the variable indicia are imaged using the same type of ink as the overprint portion or area (i.e., decorative portion, printed on top of the SOC) of the document providing common printed films for both the variable indicia and the SOC itself. Again, this embodiment greatly reduces the variable indicia's S/N ratio relative to the scratch-off area so long as the SOC remains intact.

In certain embodiments, the document's backing is imaged (i.e., back printing) using the same type of ink as the variable indicia, thereby reducing the variable indicia's S/N ratio to the document's backing when measured from the rear of the substrate. With certain such embodiments, the portion of the document's backing that is positioned directly behind the variable indicia exhibits a minimum coverage and dispersion using the same type of ink as the variable indicia.

In various embodiments, the common display, overprint, and backing applications relative to the variable indicia can be combined in various manners further reducing the variable indicia's S/N ratio relative to the document's background.

In various of these embodiments, the variable indicia can be imaged on a security ink film layer (e.g., blocking layer for opacity) or imaged directly on the document's substrate (assuming sufficient opacity can be achieved by other means). Various embodiments of the present disclosure utilize common materials and application techniques for both the document's variable indicia and other portions (i.e., display, overprint, and/or backing areas) so that tampering can be readily discerned.

Described are a number of printing mechanisms and methodologies that provide practical details for reliably producing secure variable indicia under a SOC that is highly resistant to various pick-out techniques based on the differences between the variable indicia and other portions of the document. Although the examples provided herein are primarily related to instant tickets, it is clear that the same methods are applicable to any type of document (e.g., telephone card, gift card) where information is protected by a SOC.

BRIEF DESCRIPTION OF THE OF SEVERAL VIEWS OF THE DRAWINGS

The foregoing summary, as well as the following detailed description of this disclosure, will be better understood when read in conjunction with the appended drawings. It should be understood, however, that this disclosure is not limited to the precise arrangements and instrumentalities shown. In the drawings.

Figure 4A:
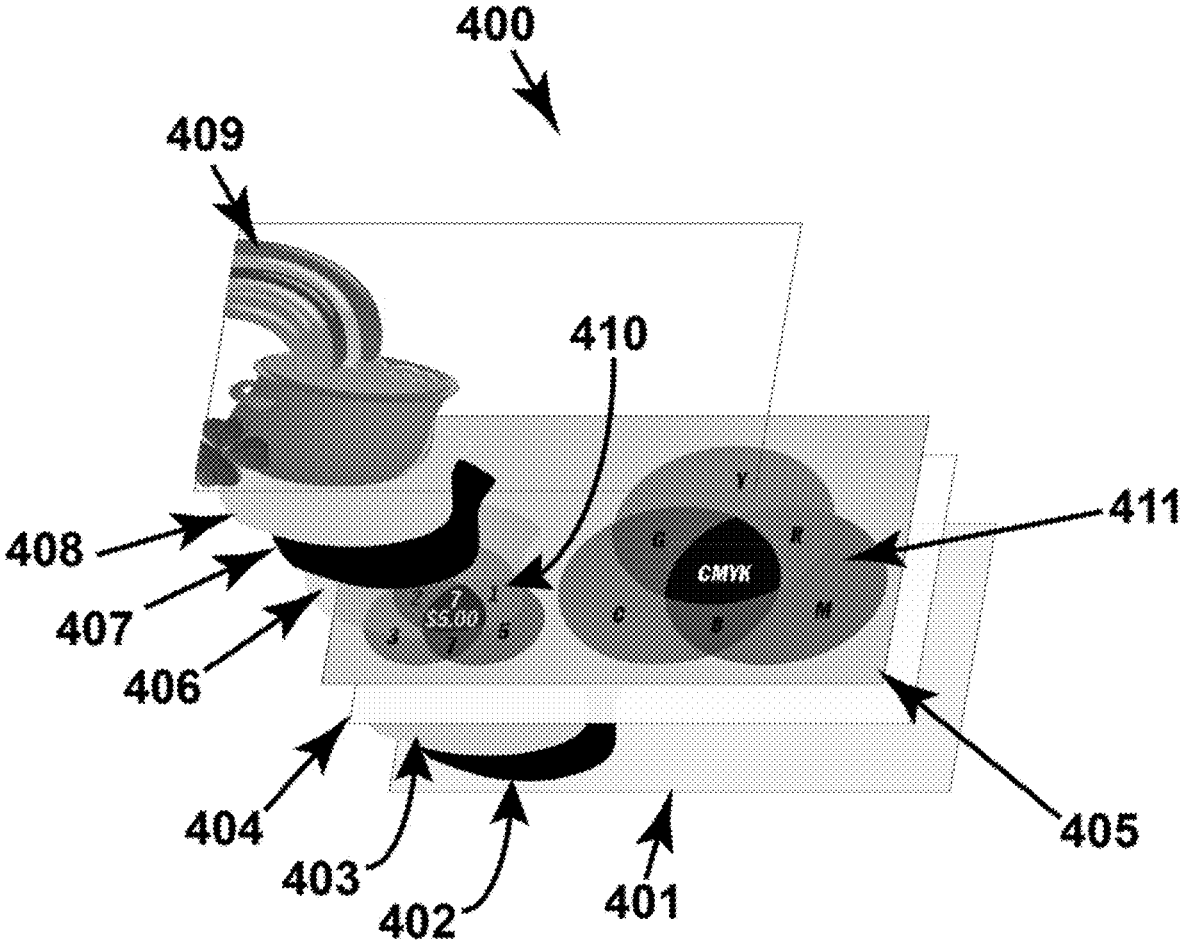
FIG. 4A is an exploded top isometric view of a first representative example of a modified lottery-type instant ticket security ink film stack utilizing variable indicia homogenized with the ticket display area and overprint area according to the present disclosure.
Figure 4B:
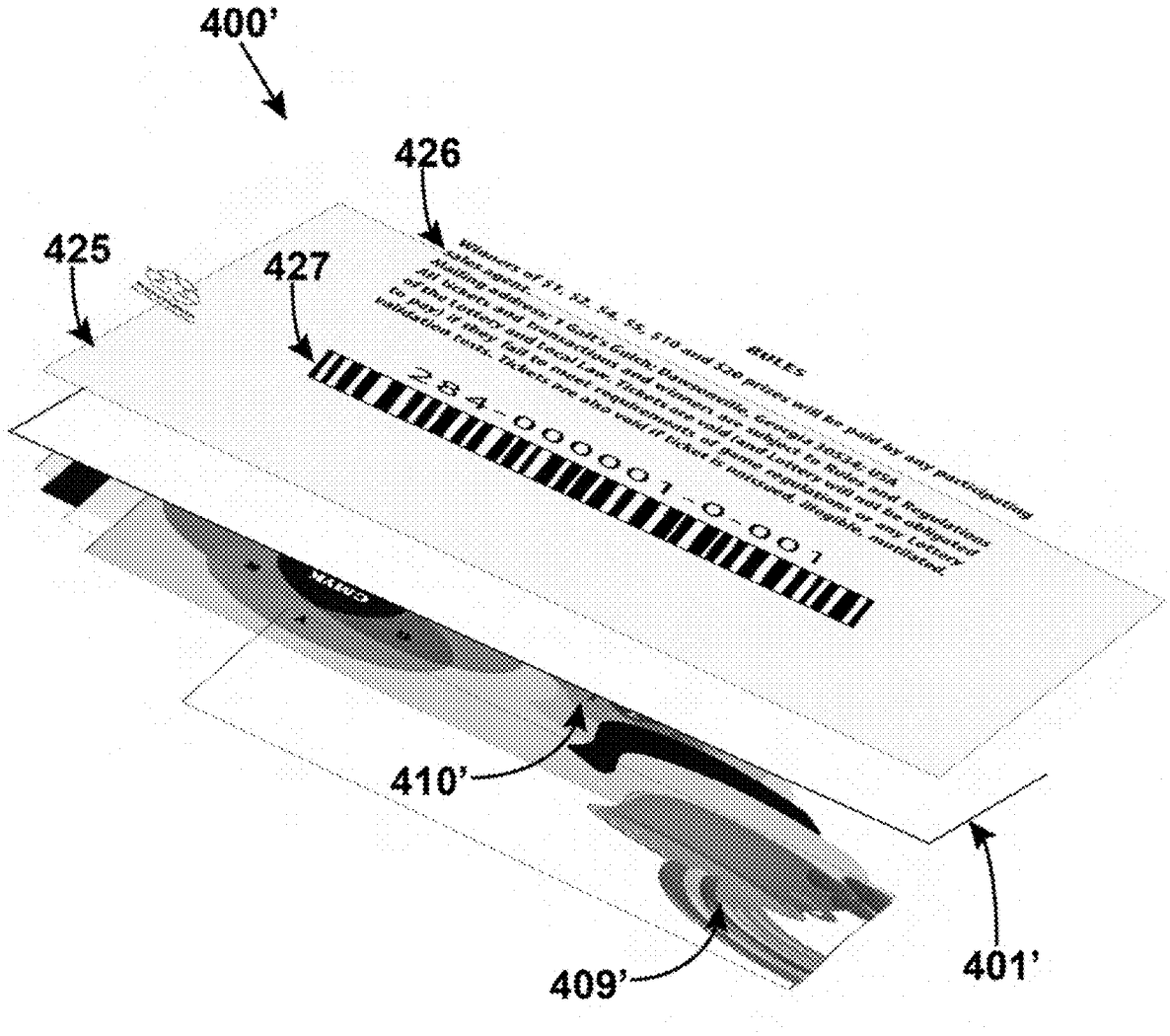
FIG. 4B is an exploded back isometric view of a first representative example of a modified lottery-type instant ticket utilizing variable indicia homogenized with the ticket back area according to the present disclosure.
Figure 4C:
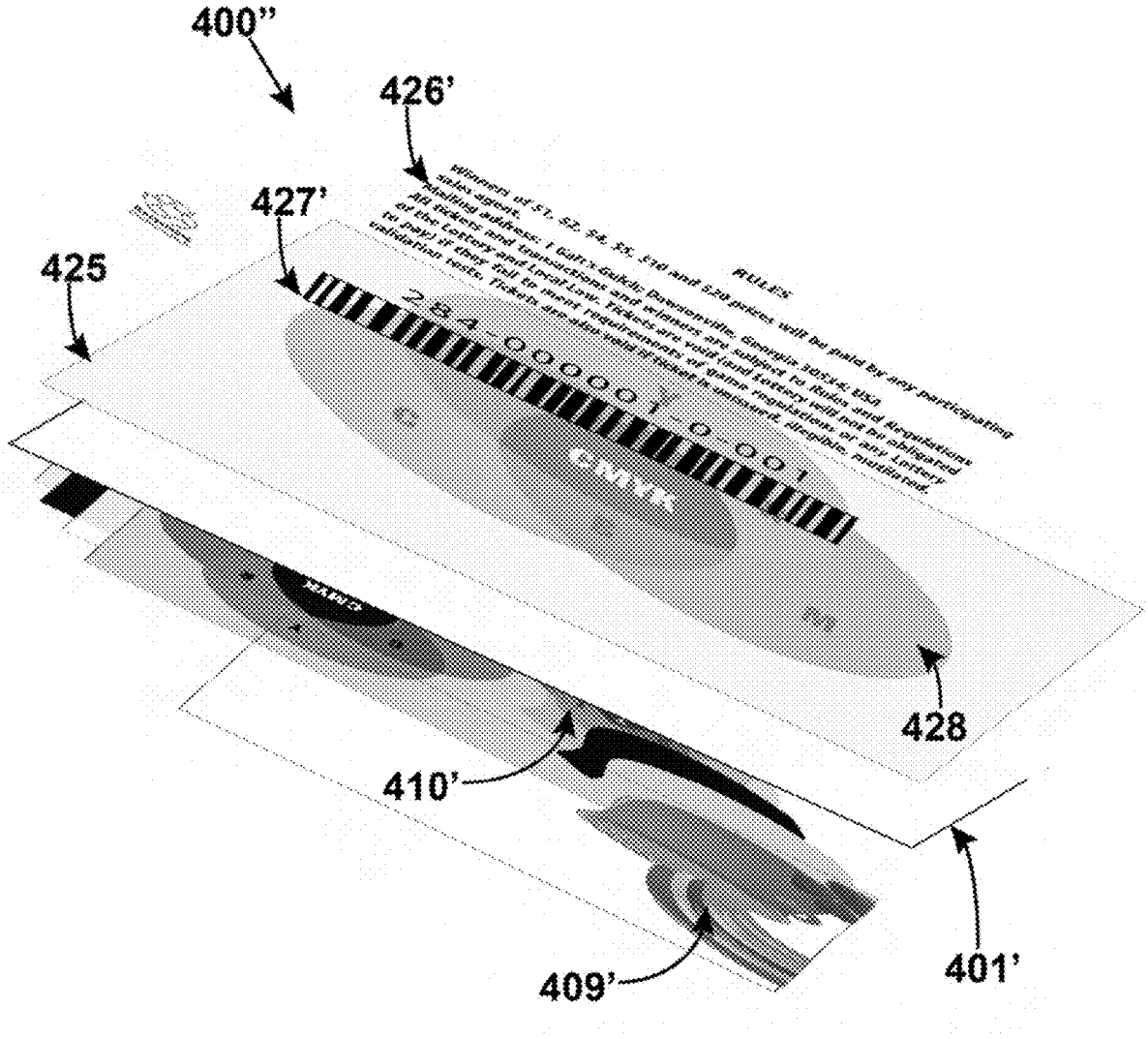
FIG. 4C is an exploded back isometric view of a second representative example of a modified lottery-type instant ticket utilizing variable indicia homogenized with the ticket back area according to the present disclosure.
Figure 7A:
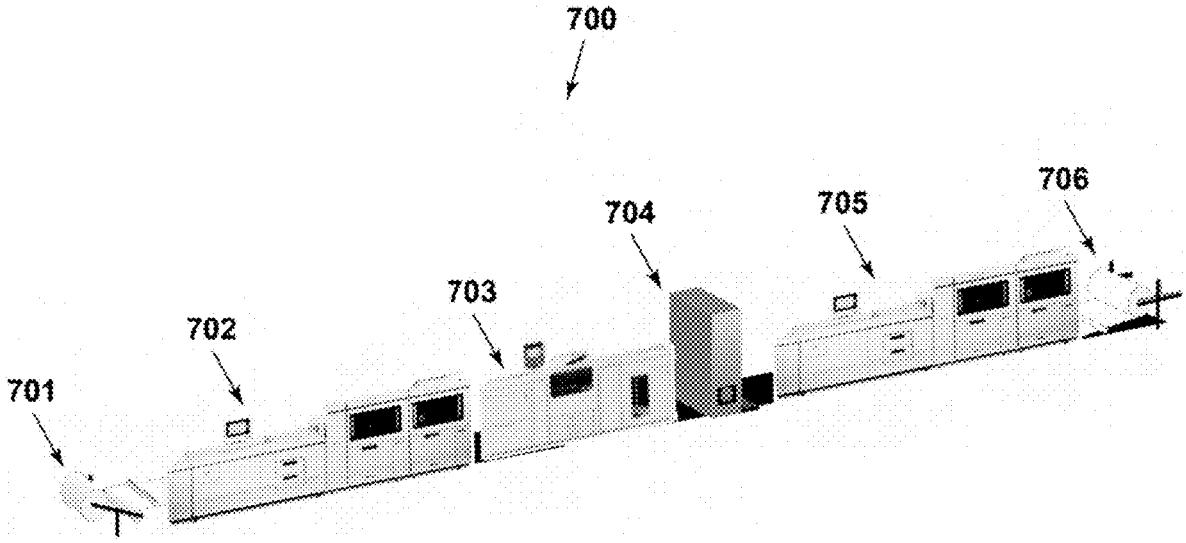
Figure 7B:
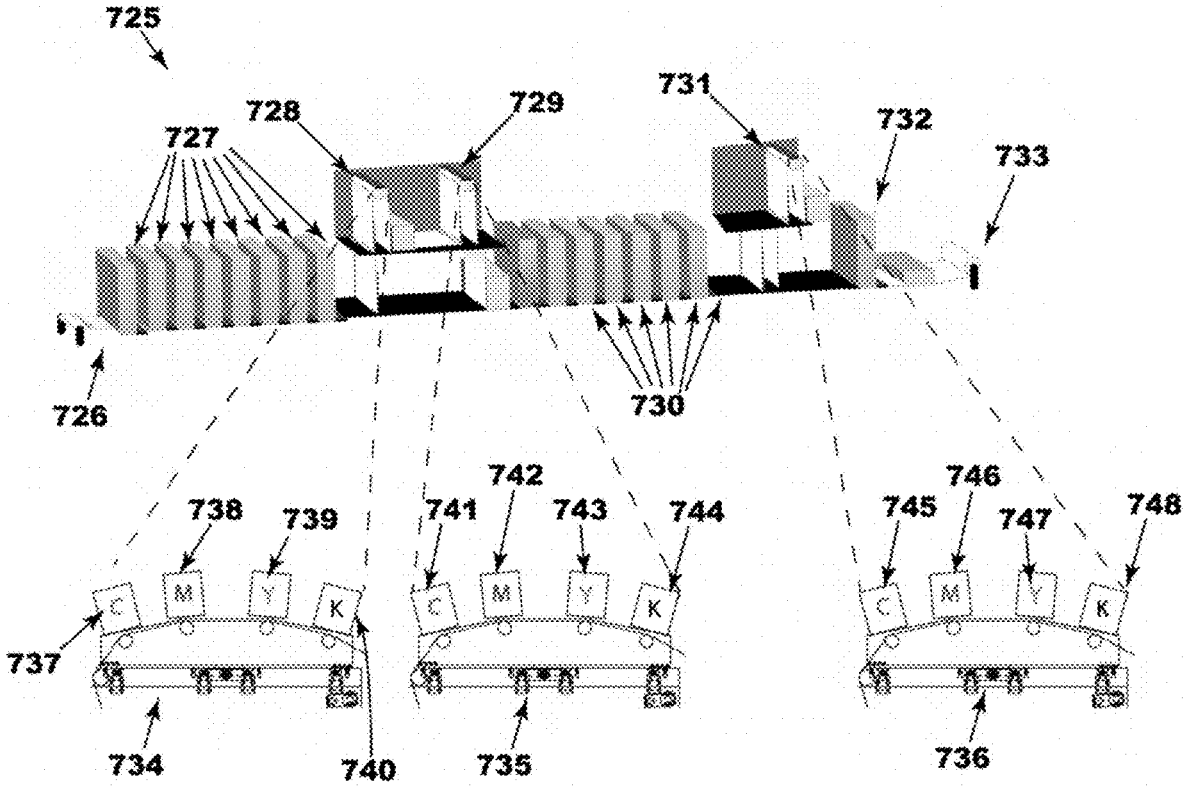

FIG. 7A is a schematic view of a first representative example of a digital press configuration capable of printing the modified lottery-type instant ticket security ink film stack of FIGS. 4A thru 4C; and FIG. 7B is a schematic view of a second preferred representative example of a digital press configuration capable of printing the modified lottery-type instant ticket security ink film stack of FIGS. 4A thru 4C.

DETAILED DESCRIPTION

As used herein, the words "image" or "print' are used equivalently and mean that whatever indicium or indicia is or are created directly or indirectly on any surface may be done by any known imaging or printing method or equipment. Likewise, "imaging" or "printing" describing a method and "imaged" or "printed" describing the resulting indicium or indicia are used equivalently and correspondingly to "image" or "print." Similarly, the term "ink jet" while typically meaning a digital printer in which droplets of ink are sprayed onto a surface to create an image, may also refer generically to other means of digitally printing an image on a substrate (e.g., laser printing, solid ink printing, monochromatic ink jet, process color ink jet) in the context of this disclosure.

Certain terminology is used herein for convenience only and is not to be taken as a limitation on the present disclosure. The words "a" and "an", as used in the claims and in the corresponding portions of the specification, mean "at least one." The terms "scratch-off game piece" or other "scratch-off document," hereinafter are referred to generally as an "instant ticket" or simply "ticket." Additionally, the terms "full-color" and "process color" are also used interchangeably throughout the specification and claims as terms of convenience for producing a variety of colors by discrete combinations of applications of pigmented primary inks or dyes "CMYK" (i.e., Cyan, Magenta, Yellow, and Black), or in some cases six colors (e.g., Hexachrome printing process uses CMYK inks plus Orange and Green inks), or alternatively eight colors—e.g., CMYK plus lighter shades of cyan (LC), magenta (LM), yellow (LY), and black (YK).

Also, as used herein, the terms "multi" or "multiple" or similar terms means at least two, and may also mean three, four, or more, for example, unless otherwise indicated in the context of the use of the terms. Also, "variable" indicium or indicia refers to imaged indicum or indicia that indicates information relating a property, such as, without limit a value of the document, for example, a lottery ticket, coupon, commercial game piece or the like, where the variable indicium or indicia is or are typically hidden by a SOC until the information or value is authorized to be seen, such as by a purchaser of the document who scratches off the SOC, revealing the variable indicium or indicia. Examples of variable indicium as a printed embodiment include letters, numbers, icons, barcodes, figures, etc.

The term "Signal-to-Noise ratio" or "S/N ratio" as used herein refers to a signal generated from an indicium or indicia such as when subjected to diffusion, fluorescence, or electrostatic charges, and of sufficient level for an illicit attacker to specifically discern the indicium or indicia relative to the level of the ticket or document's background noise or entropy—e.g., a S/N ratio greater than 1:1 (greater than 0 dB or "0 decibel"). In other words, in the context of this disclosure, the S/N of a given indicum or indicia relative to the background noise or entropy is used in the information theory sense of the term where the "entropy" of the system is the total number of possible types of indicia distributed across the ticket or document's population in a typically ergodic fashion with the "signal" being generated by the particular indicium or indicia under attack (e.g., fluorescence emission, diffused chemical traces, electrostatic attraction) and the noise typically being generated by the countermeasures added to the ticket or document or natural effects.

Finally, in the context of this disclosure, the term "variable imaging," refers to methods of printing from a digital-based image directly to a variety of documents having a SOC (e.g., instant lottery ticket). Thus, as its name implies, "variable imaging" can vary from document-to-document and may include text, icons, drawings, photographs, etc. Any of the commercially available off-the-shelf digital printers (e.g., Memjet, Hewlett Packard or "HP" Indigo, Xerox CiPress series, Kodak) are capable of printing the "variable imaging" as described by this disclosure.

Before describing the present disclosure, it is useful to first provide a brief description of the current state of the art of instant ticket production and validation (in addition to the explanation in the above background section). The concept is to ensure that a common lexicon is established of existing prior art systems prior to describing the present disclosure. This description of the current state of the art of instant ticket production and validation is provided in the discussions regarding FIGS. 1 through 3B.

Figure 1:
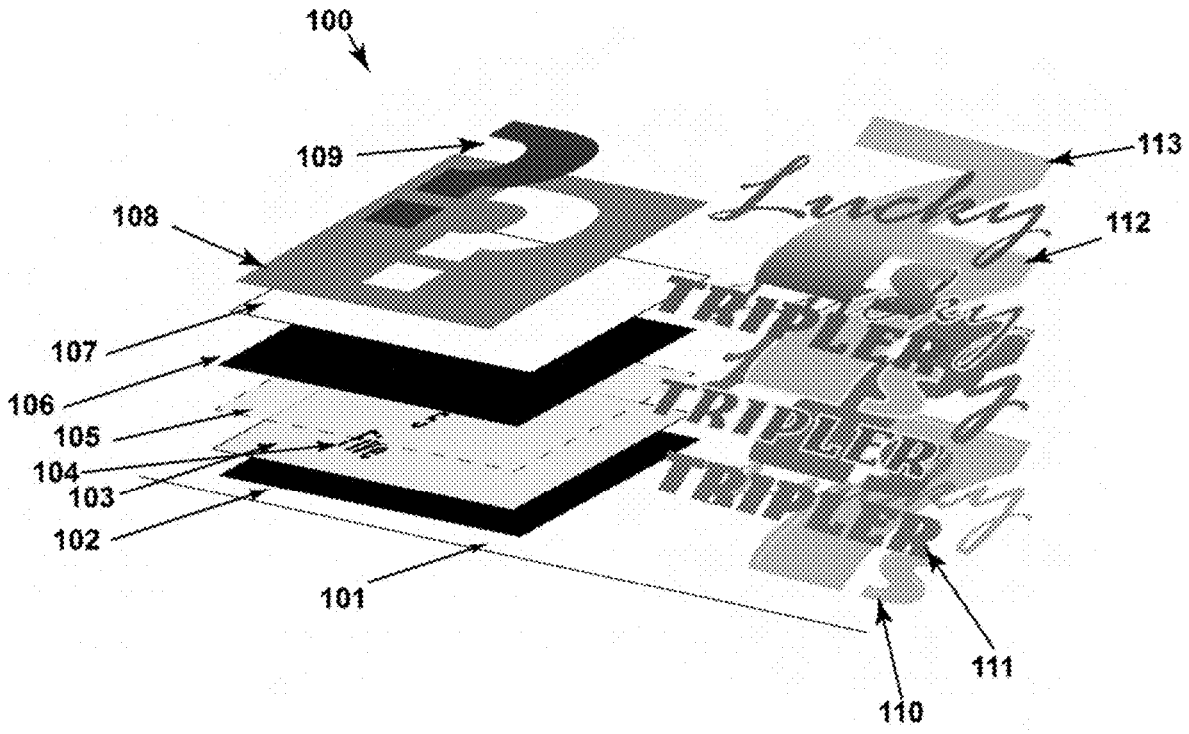
FIG. 1 PRIOR ART
FIG. 1 is an exploded top isometric view of a representative example of a prior art traditional lottery-type instant ticket security ink film stack where the variable indicia is applied as a separate process and ink film.

FIG. 1 depicts a representative example of the variable indicia and associated security ink stack typical of a traditional ink jet SOC secured document—i.e., an instant lottery ticket 100. As shown in FIG. 1, the printed variable indicum 104 is between lower security ink films 102 and 103 and upper security ink films 105, 106, and 107 providing chemical barriers potentially protecting the variable indicum 104 from diffusion, fluorescence, electrostatic, and other known attacks. The entire ink film stack is deposited on a paper, foil, or other substrate 101. The lower security-ink film layers include optional layer 102 (not required for a foil substrate) providing opacity and diffusion barriers, as well as at least one higher contrast (e.g., white or gray against a black or other dark color) layer 103 so that a human consumer can read the variable indicum 104. The upper security ink film layers also isolate the variable indicum 104, first with a release coating 105 that helps seal the variable indicia to the substrate 101 and lower ink film layers as well as causing any ink films printed on top of the release coating 105 to scratch-off. The SOC comprises one or more layers, and typically several, so that the variable indicum 104 is not visible until the ticket is played by the SOC being legitimately scratched-off. The SOC layer of exemplary ticket 100 comprises at least one upper opacity layer 106 that is applied to help protect against candling and fluorescence attacks. On top of the opacity layer(s), at least one white ink film 107 layer is typically applied that provides a higher contrast background for overprint inks. Finally, decorative overprint ink areas or layers 108 and 109 are applied for both an attractive appearance of the SOC area, as well as sometimes providing additional security. In addition to the security ink stack and variable indicia of portions of ticket 100, the ticket also has printed decorative display area layers 110 through 113 configured to make the ticket 100 more attractive and possibly provide instructions for game play. The printed ink film "layers" mentioned herein may be applied in any form and in any image and with multiple applications. Thus, ink film "layers" as used herein is equivalent to "areas" or "portions" of the ticket. Typically, the display area printing is printed as an offset or flexographic (i.e., fixed printing plate) process color in which four primary printing colors Cyan 110, Magenta 111, Yellow 112, and Black 113 (a.k.a., "CMYK") are blended in varying intensity to mimic colors perceived by a human eye. However, other printing processes and techniques may be used if desired.

Thus, a large number of security ink film layers (seven in the example of FIG. 1) are required to protect and allow for only legitimate consumer readability of the variable indicum 104 of a properly played or scratched-off prior art SOC protected document, such as an instant lottery ticket. Of course, the example of FIG. 1 is just one possible arrangement of a prior art SOC protected document with security ink film layers, with the goal of any security ink film layer arrangement being to provide barriers to outside attempts to discern the variable indicum or indicia without properly removing the SOC.

These security ink film layers have been highly evolved to provide security countermeasures against various diffusion, fluorescence, electrostatic, and other attacks as they became known to the industry. Thus, the barriers are highly tuned to known attacks and not necessarily helpful against new attacks that utilize previously unknown agents or excitation wavelengths. The industry typically modifies these highly tuned and complex security barriers only when a new attack becomes apparent in the art.

Figure 2A:
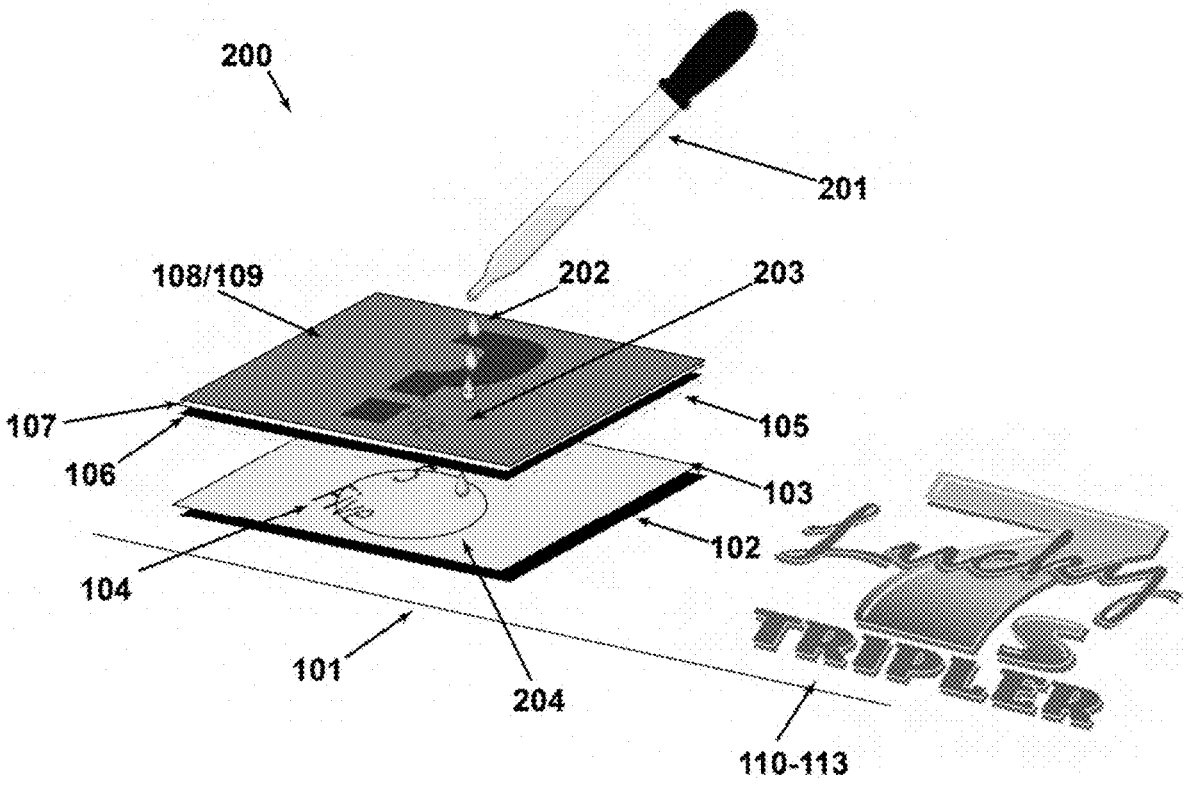
FIG. 2A PRIOR ART
FIG. 2A is an exploded top isometric view of the traditional prior art lottery-type instant ticket security ink film stack of FIG. 1 under a diffusion attack through the front overprint layers.

For example, FIG. 2A illustrates a diffusion attack on an instant ticket 200 where a solvent 202 that was selected to diffuse the chemistry of the ink jet variable indicia 104, such that when the solvent 202 is gently applied by an eye dropper 201, the solvent 202 unobtrusively penetrates through the decorative overprints 108 and 109, the white ink film 107, the upper opacity layer 106, and the release coat 105 without disturbing their chemical bond to the ticket 100, the ink stack (102 through 109), or the substrate 101, thereby enabling those layers to appear intact and undisturbed. If the solvent 202 is properly selected it will saturate an area 204 around the variable indicia 104 and cause a small portion of the variable indicia to diffuse through the upper security layers and the overprints (105 thru 109) to reveal a faint ghost image 203 of the underlying variable indicia 104. As is typical of these types of attacks, once the ticket 200 is allowed to dry, the ghost image 203 typically disappears leaving virtually no trace that the ticket 200 was compromised for pick-out of the variable indicia 104 via diffusion.

This type of attack 200 relies on the ink jet variable indicum or indicia 104 of the prior art lottery ticket being comprised of a separate chemical composition than the upper ink layers (105 through 109) and possibly the lower security ink layers (102 and 103) and the display portion (110 through 113) as well as the ticket back printing on the opposite side of the substrate. This works because prior art traditional tickets typically employ an ink jet dye for printing the variable indicum or indicia 104 that is generally comprised of a chemistry that is substantially different than the security ink layers (102 through 103 and 105 through 107), overprint areas 108 and 109, display areas 110 through 113, and the ticket back printing. This is generally because the variable indicia 104 changes from ticket-to-ticket and the high volumes of scratch-off documents produced in a typical print run require the variable indicia to be printed at high speeds (e.g., 600 to 1,000 Feet Per Minute or "FPM") and at as low a cost as possible to be economically feasible. When these considerations are combined the variable indica 104 along with the associated barcode and inventory control number (back of ticket substrate) are typically the only variable data printed on a ticket printed with the more expensive ink jet ink or dye.

Known diffusion attacks (e.g., alcohol) through the front of the ticket or document have been mitigated by attempting to make the security barriers impervious to solvents 202 of the ink jet variable indicum or indicia 104. The upper release coat 105 in particular has become of increasingly exotic nature both in terms of chemistry and application. The current state-of-the-art is to cure the release coat with direct energy such as an electron beam in a controlled atmosphere or via Ultraviolet (UV) exposure. However, the possibility always remains that a new solvent may be discovered that penetrates these coatings and thereby defeats the existing countermeasures. In other words, so long as the materials and possibly application of the ink jet variable indica 104 remain different than the ticket's other ink film layers the chance always remains to achieve a S/N ratio sufficient to discern the variable indicum or indica 104 via a ghost image 203 without removing the SOC.

Figure 2B:
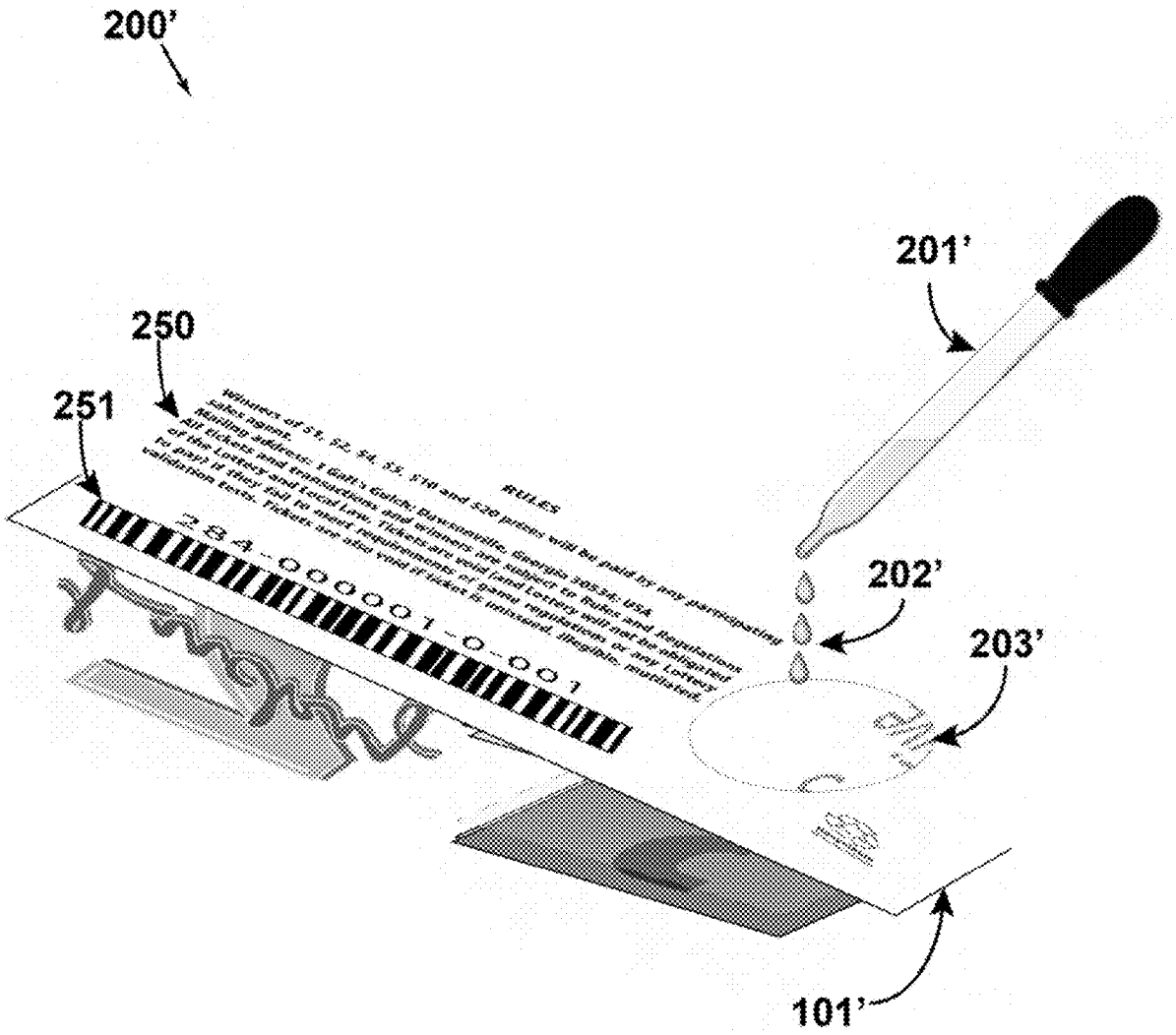
FIG. 2B PRIOR ART
FIG. 2B is an exploded top isometric view of the traditional prior art lottery-type instant ticket security ink film stack of FIG. 1 under a diffusion attack through the back of the ticket's substrate.

Of course, diffusion attacks may also be attempted in the opposite direction (i.e., through the back of the substrate 101 and the lower security coatings 102 and 103 of FIG. 1) where the barrier seals may not be as sophisticated due to the high graphic adhesion requirements of the lower security coatings. For example, FIG. 2B illustrates an exemplary diffusion attack on the back of an instant ticket 200' where a solvent 202' was selected to combine with the chemistry of the ink jet variable indica 104 (FIG. 2A) such that when the solvent 202' (FIG. 2B) is gently applied by an eye dropper 201', the solvent 202' unobtrusively penetrates through the ticket substrate 101' and the lower security ink film layers (e.g., 102 and 103 of FIGS. 1 and 2A) without disturbing the substrate 101' (FIG. 2B) or the legal text 250 and barcode 251 typically on the back of the ticket, thereby enabling the ticket to appear pristine after the diffusion attack is allowed to dry. As illustrated in FIG. 2B, in certain prior art tickets, the legal text 250 and the barcode 251 remain pristine simply because there is typically no effort in the prior art to ensure that legal text 250 and/or the barcode 251 overlay the opposite side of the ticket from the variable indicia. While the barcode 251 is typically imaged using the same ink chemistry and application technique as the variable indicia, it is normally not positioned on the opposite side of the ticket from the variable indicia (as shown in FIG. 2B) and consequently does not typically provide any security countermeasures to diffusion attacks. The legal text 250 is another matter, while it may or may not be positioned on the opposite side of the ticket from the variable indicia its positioning is typically irrelevant to serve as a countermeasure for diffusion attacks since, primarily for economic reasons, the legal text 250 is generally comprised of a completely different ink chemistry than the variable indicia and accordingly does not dissolve or diffuse under diffusion attacks through the back of the ticket that utilize a solvent 202' configured for the variable indica.

The same concept of differing materials and applications for the variable indicia relative to the rest of the document enabling selective security attacks without removing the SOC can be applied to fluorescence and electrostatic attacks. In the special case of electrostatic attacks, the differential charge in the hidden variable indicia generally is usually neutralized using anti-static barriers typically comprising a conducting polymer (plastic) and a solvent made from deionized water and alcohol. When printing, the solvent evaporates, leaving behind an invisibly thin conducting film on the surface of the printed image that shields differential charge build-up, thereby providing a shield against most types of electrostatic attacks. However, since the variable indicia uses fundamentally different ink chemistry than the rest of the document, the possibility still remains that some charge differential may be found in the future using an unknown technique (e.g., higher voltage, differing polarity, alternating current imaging, etc.) that enables the variable indicia to be read without removal of the SOC.

Fluorescence attacks are yet another matter; the large numbers of potential excitation wavelengths that may induce fluorescence in differing wavelength(s) are literally in the hundreds of thousands. Also, the long molecular chains of Volatile Organic Compound (VOC) dyes (typical of variable indicia ink jet dye) tend to be susceptible to fluorescence over multiple excitation wavelengths. What is more, subtle variation in the chemistry of the ink used for the variable indicia may greatly alter its fluorescence characteristics, inadvertently causing emissions to occur with excitation wavelengths and fluorescence emission wavelengths previously thought to be secure. Given that the bandwidth of possible excitation and emission wavelengths is so large and that fluorescence attacks may be timed exposures over a narrow (i.e., fluorescence emission) bandwidth, it is extremely difficult to engineer reliable opacity blocking layers sufficient to ensure security over a large press run. The underlying problem is that timed exposures over a filtered narrow band centered about the fluorescence emission wavelength of the variable indicia enables an extremely small quantity of photons emissions from the variable indicia fluorescence transmitted through the upper or lower security layers to be collected over time, thereby enabling a sufficient S/N ratio to discern the variable indicia of a document with the SOC intact.

Figure 3A:
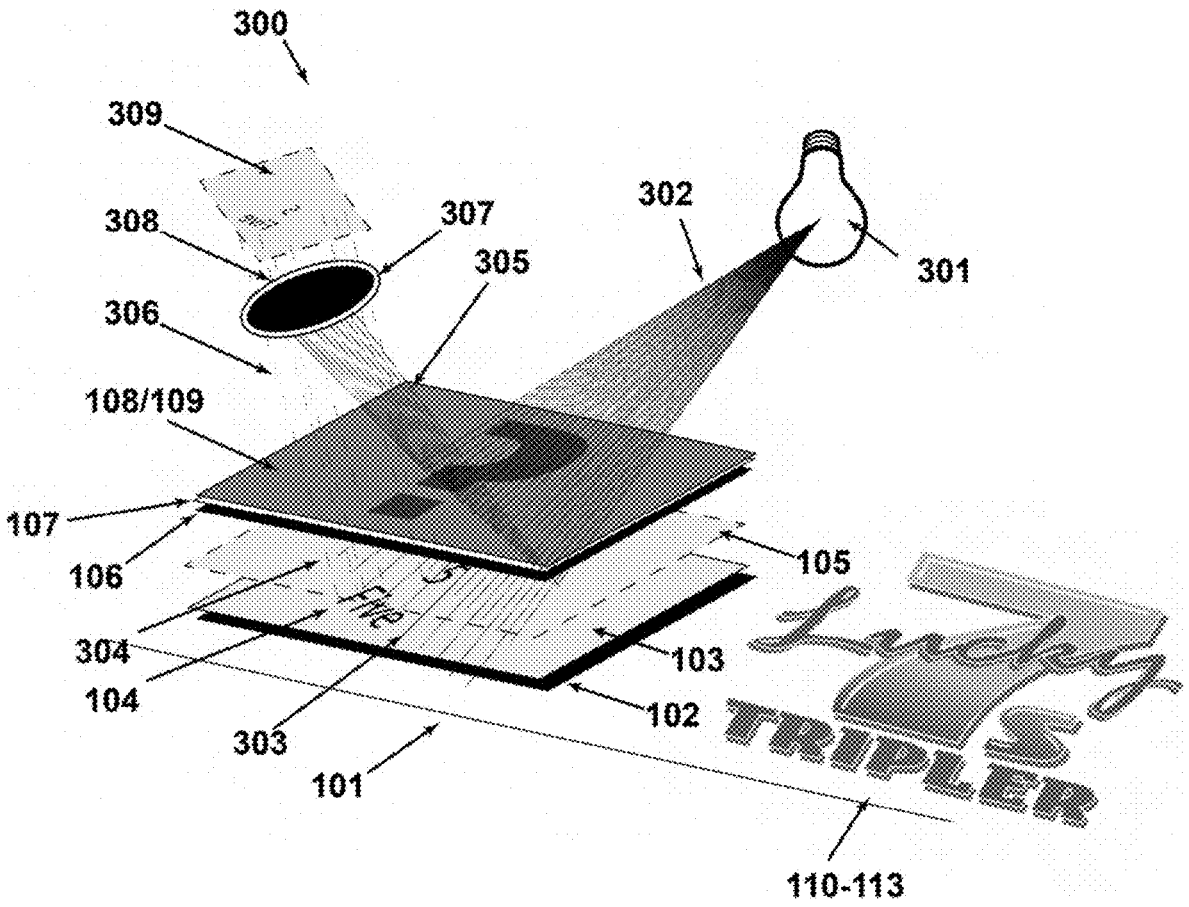
FIG. 3A PRIOR ART
FIG. 3A is a partially exploded top isometric view of the prior art traditional lottery-type instant ticket security ink film stack of FIG. 1 under a fluorescence attack through the front overprint layers.

For example, FIG. 3A illustrates one possible method to induce sufficient fluorescence in the variable indicia 104 of a traditional prior art document or ticket 300 front that are covered by SOC security layers 105 through 107 and overprint layers 108 and 109 such that the variable indicia information may be ascertained while leaving the SOC pristine. In FIG. 3A, an excitation light source 301 generates excitation photons of a desired wavelength 302 (e.g., $\lambda$=488 nm—blue light) in sufficient quantity and intensity to penetrate, albeit with attenuated photons 303, the upper blocking SOC security layers 105 through 107) and overprint areas 108 and 109 thus inducing fluorescence 304 in the traditional prior art ink jet variable indicum or indicia 104. Since the induced ink jet variable indicum or indicia fluorescence 304 will be a different and longer wavelength (e.g., $\lambda$=850 nm—Infrared or "IR" light), the lesser number of fluorescence photons that penetrate through the SOC security layers 105 through 107 and overprint areas 108 and 109 to radiate from the ticket or document's surface 306 potentially provide a large enough S/N ratio sufficient to produce an image 309 of the previously hidden variable indicum or indicia 104, using a timed exposure camera where a bandpass optical filter 307 blocks the much more intense reflected excitation light source 305 only enabling the longer wavelength fluorescent light 308 to pass to the time exposure camera. In this example, any fluorescence exhibited by the display (110 thru 113) and/or overprint (108 and 109) will typically be of a different wavelength due to the display and overprint ink's different chemical composition from the variable indicum or indicia.

Figure 3B:
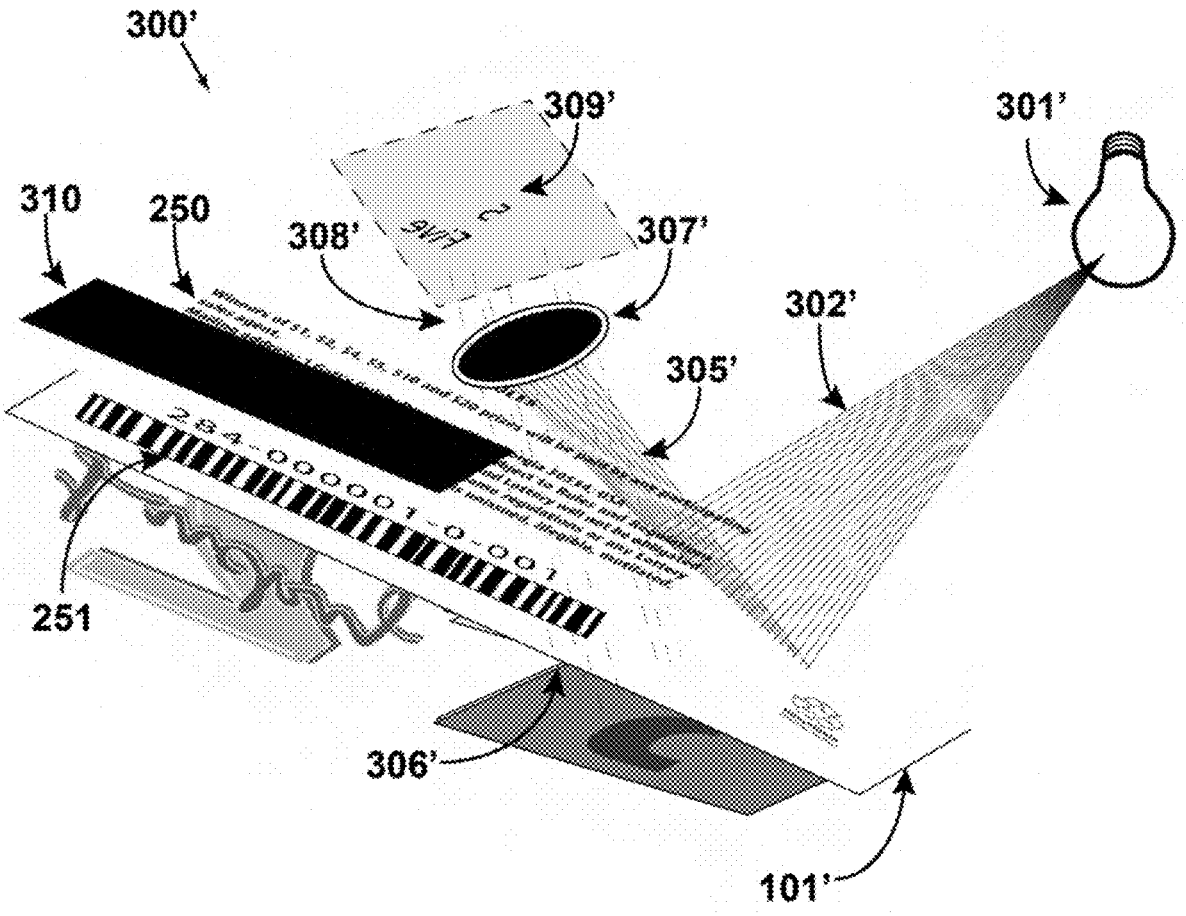
FIG. 3B PRIOR ART
FIG. 3B is a partially exploded top isometric view of the prior art traditional lottery-type instant ticket security ink film stack of FIG. 1 under a fluorescence attack through the back of the ticket's substrate.

Like diffusion attacks, fluorescence attacks may also be attempted in the opposite direction (i.e., through the back of the substrate 101 and the lower security coatings 102 and 103 of FIG. 1). For example, FIG. 3B illustrates an exemplary fluorescence attack on the back of an instant ticket 300' where an excitation light source 301' generates excitation photons of a desired wavelength 302' in sufficient quantity and intensity to penetrate the ticket substrate 101' and lower security layers (102 and 103 of FIG. 1) thereby inducing fluorescence 306' (FIG. 3B) in the traditional prior art ink jet variable indicia. Since the induced ink jet variable indicia fluorescence 306' will be a different and longer wavelength, the lesser number of fluorescence photons that penetrate through the lower security layers and ticket substrate to radiate from the ticket or document's backing 306' potentially still provide a large enough S/N sufficient to produce an image 309' of the previously hidden variable indicum or indicia, using a timed exposure camera where an optical bandpass filter 307' blocks the much more intense reflected excitation light source 305' only enabling the longer wavelength fluorescent light 308' to pass.

As illustrated in FIG. 3B there is again typically no effort in the prior art to ensure that legal text 250 and barcode 251 overlay the opposite side of the ticket from the variable indicum or indicia. The legal text 250 may or may not be positioned on the opposite side of the ticket from the variable indicum or indicia since it is typically comprised of a completely different ink chemistry than the variable indicia and accordingly does not naturally fluoresce (if at all) in the same wavelength as the variable indica. However, the barcode 251 is usually imaged using the same ink chemistry as the front variable indicia and consequently will fluoresce in the same wavelength as the variable indicia when exposed to the same excitation light source 302' thereby greatly increasing the noise most likely to the point that the variable indicum or indicia cannot be ascertained. Unfortunately, assuming the barcode is not directly positioned over the opposite side of the ticket from the variable indicum or indicia (as shown in FIG. 3B) its fluorescence noise source can be eliminated by simply covering the barcode 251 with an opaque object 310 (e.g., strip of sheet metal, tape). Even if the barcode is positioned directly over the opposite side of the ticket from the variable indicum or indicia the relatively narrow shape and size of the barcode when compared to the typically much larger area occupied by variable indicia (i.e., the variable indicia is human readable and discloses the win or lose game status of each ticket, consequently the variable indicia typically occupies a significant percentage of the ticket's front surface with the back printed machine readable "overhead" barcode and human readable inventory number typically only occupying an area around 1 to 2 inches wide and 0.5 inch tall) would at best provide a security countermeasure to only a small portion of the variable indicia or perhaps a single variable indicum which typically would not suppress sufficient prize information to serve as an effective countermeasure.

Reference will now be made in detail to examples of the present disclosure, one or more embodiments of which are illustrated in the drawings. Each example is provided by way of explanation of the disclosure, and not meant as a limitation of the disclosure. For example, features illustrated or described as part of one embodiment, may be used with another embodiment to yield still a further embodiment. It is intended that the present disclosure encompasses these and other modifications and variations thereof within the scope and spirit of the disclosure.

All of these previous disclosed types of attacks (i.e., diffusion, electrostatic, and fluorescence) exploit the different types or chemistries of ink of the variable indicum or indicia 104 (typically ink jet dye) relative to the rest of the ink used in the prior art document or lottery ticket 100 (see FIG. 1) to obtain sufficient S/N to discern the variable indicum or indicia without removing the SOC. However, any differences between the materials of the variable indicum or indicia and the display, overprint, or back areas of a document or ticket are typically eliminated with this disclosure of utilizing the same ink to print the variable indicum or indicia and display, overprint, and/or backing areas. In other words, imaging the SOC overprints and the ticket back with the same ink chemistry as the variable indicum or indicia enhance the commonality of the ticket or document. Thus, by utilizing common, (also called homogenous) materials over at least other portions of the document or ticket as well as the variable indicum or indicia typically eliminates any attempt to garner a sufficient S/N ratio of the variable indicum or indicia ink relative to the rest of the document's background noise to discern the hidden variable indicum or indicia.

FIG. 4A provides an embodiment of an exploded front isometric view of a modified document utilizing secure variable indicia 410 according to the present disclosure in the form of an exemplary lottery-type instant ticket 400. The ticket includes a substrate 401 having at least one lower opacity security ink film 402 layer with at least one higher contrast security ink film layer 403 applied below the variable indicia 410. With this exemplary embodiment, an ink jet primer 404 may be optionally flood coated over both the lower security area(s) and the remainder of the document's front surface. Next, the variable indicia 410 and preferably the front display portion 411 are applied as a homogeneous ink film layer 405 across the front of the document. Covering the variable indicia portion 410 is at least one clear release coat layer 406 that is direct energy cured (e.g., electron beam, ultraviolet) providing an initial transparent protective ink film coating that will cause all subsequent applied ink films to scratch-off—i.e., Scratch-Off Coatings or "SOC". At least one upper opacity coating layer 407 is then applied on top of the release coat layer 406 with at least one high contrast white primer ink film layer 408 printed on top of the at least one upper opacity coating layer 407. Finally, a decorative overprint layer 409 is applied on top of the SOC coatings with the same ink chemistry that was used to print the variable indicia 410.

Thus, the embodiment of FIG. 4A illustrates the variable indicia 410 and ticket display 411 printed as part of the same homogenous process color digital imager layer 405 on the lottery-type instant ticket 400. For the purposes of this embodiment, the type of digital imager ink or material (e.g., toner based, thermal transfer, pigmented ink jet, dye based ink jet, etc.) and the method or technique of applying the homogenous variable indicia 410 and display 411 ink film layer 405 to the ticket 400 is irrelevant; the disclosure is that the variable indicia 410 and display area 411 layer are to be applied with the same ink chemistry. Since the resulting homogenous ink film layer 405 comprises both the variable indicia 410 and the display 411 portions there can no longer be any significant S/N ratio derived from differences between the variable indicia 410 and the display 411 portions. Therefore, the underlying concept of diffusion, electrostatics, and fluorescence attacks exploiting a positive S/N ratio of the variable indicia ink 410 relative to the ticket display 411 background ink noise predictably becomes no longer possible. In other words, whatever attack that attempts to exploit any unique characteristic of the variable indicia 410 will also extract the same characteristic from the display area noise with no significant S/N ratio possible. This reduction of variable indicia 410 signal relative to the ticket's 400 background noise can be further enhanced by imaging the overprint area layer 409 with the same process color digital imaging inks that were used to generate the variable indicia 410 and optionally the display 411 portion.

As its name implies, the overprint 409 is printed after the variable indicia 410 on top of SOC layers 407 and 408 and therefore cannot be imaged at the same time as the variable indicia 410. However, by digitally imaging the overprint 409 portion with the same materials (ink) as the variable indicia 410, the same effect of eliminating any intelligible variable indicia S/N ratio relative to the remainder of the ticket 400 noise is achieved, especially for attacks (e.g., fluorescence, electrostatics, diffusion) that physically transverse the SOC.

In an alternative embodiment, the display portion 411 can be optionally imaged with the same application as the overprint portion 409, providing a homogeneous ink film layer encompassing the overprint portion 409 and the display portion 411 with the variable indicia 410 being printed with the same ink(s) albeit by a different (prior) application. In certain applications this alternative embodiment may be preferred where it is desirable to ensure that the overprint portion 409 and display portion 411 graphics seamlessly blend together and may also provide a countermeasure to unassisted and assisted SOC lifting techniques where the SOC is temporally "lifted" by a mechanical mechanism, which enable the underlying variable indicia to be observed and then the SOC rolled back into position with an adhesive thus making the document or ticket to appear uncompromised. This alternative embodiment would provide a countermeasure to these unassisted and assisted SOC mechanical lift attacks by eliminating any clear demarcation between the overprint area 409 and display area 411 with any mechanical lift attempt disrupting the homogenous overprint area 409 and display area 411. This disruption in image effect can be enhanced by including fine lines and/or other micro-printing around the boundary between the overprint area 409 and display area 411.

The variable indicia may also be homogeneous with other portions of the ticket or document including any imaging located on the ticket's back. For example, FIG. 4B illustrates an embodiment 400' where the portion of the back of the ticket's substrate 401' that overlays the opposite side of the ticket from the variable indicia 410' is intentionally printed with legal text 426 with the same ink as the variable indicia resulting in a generally uniform heterogeneous coverage of the backing overlapping variable indicia area—i.e., legal text ink uniformly distributed across the overlapping variable indicia area. Thus, with embodiment 400' the generally uniform heterogeneous coverage of legal text 426 is also digitally imaged using the same ink chemistry as the variable indicia 410', thereby creating a homogeneous countermeasure across the ticket or document's back 401' which overlaps the variable indicia 410'. As with the previously discussed homogeneous overprint countermeasure 409', by uniformly covering the back of the ticket portion that overlaps the variable indicia with digitally imaged legal text 426 comprised of the same materials (ink) as the variable indicia 410', the same effect of suppressing any intelligible variable indicia signal relative to the ticket 400' noise is achieved, especially for attacks (e.g., fluorescence, electrostatics, diffusion) that physically transverse the back of the ticket. Preferably, a primer coating 425 is flood coated over the back of the substrate 401' prior to any homogeneous legal text imaging. Of course, the barcode 427 would also be digitally imaged with the same materials (ink) as the variable indicia 410' and thereby add to the increasing of the noise floor countermeasure, but as previously described the barcode 427 by itself does not cover a large enough area to provide the generally uniform homogeneous coverage across the entire overlapping area of the variable indicia 410' and consequently as also previously described can be easily thwarted.

Thus, the size, amount, and the uniformity of the distribution of the homogeneous coverage of the overlapping variable indicia back area impacts the effectiveness of increasing the noise floor countermeasure through the ticket back. Generally, coverage of the overlapping variable indicia back area should be uniformly spread—e.g., ≤0.25 inch or ≤6.35 mm white spacing (i.e., no ink printed) between imaging when mean averaged—over at least 50% of the overlapping variable indicia back area. In various embodiments, at least 20% of the at least 50% overlapping variable indicia 410' back area should contain the same materials (ink) as the variable indicia 410'. In certain embodiments, imaging legal text 426 that is ≤18-point font with the same ink chemistry as the variable indicia over at least 50% of the overlapping variable indicia 410' back area will meet this requirement—e.g., a 10-point legal text overlay equates to 0.1 inch or 2.54 mm worst case mean average spacing. Alternatively, if the variable indicia 410' are imaged in process colors, imaging the ticket back legal text 426 in "rich black" (e.g., 100% cyan, 100% magenta, 100% yellow, and 100% black) will have the advantage of theoretically providing a higher level of security since all of the process colors' ink chemistry will be present in the legal text 426 with the disadvantage of higher costs due to increased ink consumption. Therefore, with at least 50% of the overlapping variable indicia 410' back area uniformly covered with homogeneous digital imaging, the prior art nefarious fluorescence attack technique disclosed in FIG. 3B of simply covering ticket back digital imaging with an opaque object 310 (e.g., strip of sheet metal, tape) to eliminate florescence noise will be ineffective since the covering would also block any underlying signal from the variable indicia 410' (FIG. 4B) due to the reverse side minimum 50% coverage requirement.

While strategically placing the legal text 426 over at least 50% of the overlapping variable indicia 410' back area provides adequate homogeneous security countermeasures for most ticket configurations, there are variable indicia layouts associated with larger tickets (e.g., ≥6×4 inches or ≈15.2×10.2 cm) where the overlapping variable indicia 410' back area is simply too large and/or the overlapping variable indicia 410' back area is segmented into different portions. With these types of ticket configurations, it is preferred to include at least one additional homogeneous digital imaging portion on the back of the ticket. For example, FIG. 4C shows the same exploded rear isometric view 400" of the modified ticket of FIG. 4B with secure variable indicia 410' (FIG. 4C) imaged on the front side of the substrate 401' with legal text 426' and the barcode 427' overlapping the variable indicia 410' back area. However, in FIG. 4C there is an additional homogeneous digitally imaged display portion 428 also imaged in the overlapping variable indicia 410' back area. The exact configuration of the additional homogeneous digitally imaged display portion 428 is irrelevant in various embodiments because the concept is to provide coverage of the overlapping variable indicia 410' back area(s) in addition to or instead of the legal text 426'. As illustrated in FIG. 4C the additional homogeneous digitally imaged display portion 428 is imaged partially transparent (e.g., 33% opacity as shown in FIG. 4C) to ensure sufficient contrast for the legibility of any overlapping legal text 426'. The additional homogeneous digitally imaged display portion 428 is not extended to the general area surrounding the barcode 427' to ensure high read rates.

Figure 5A:
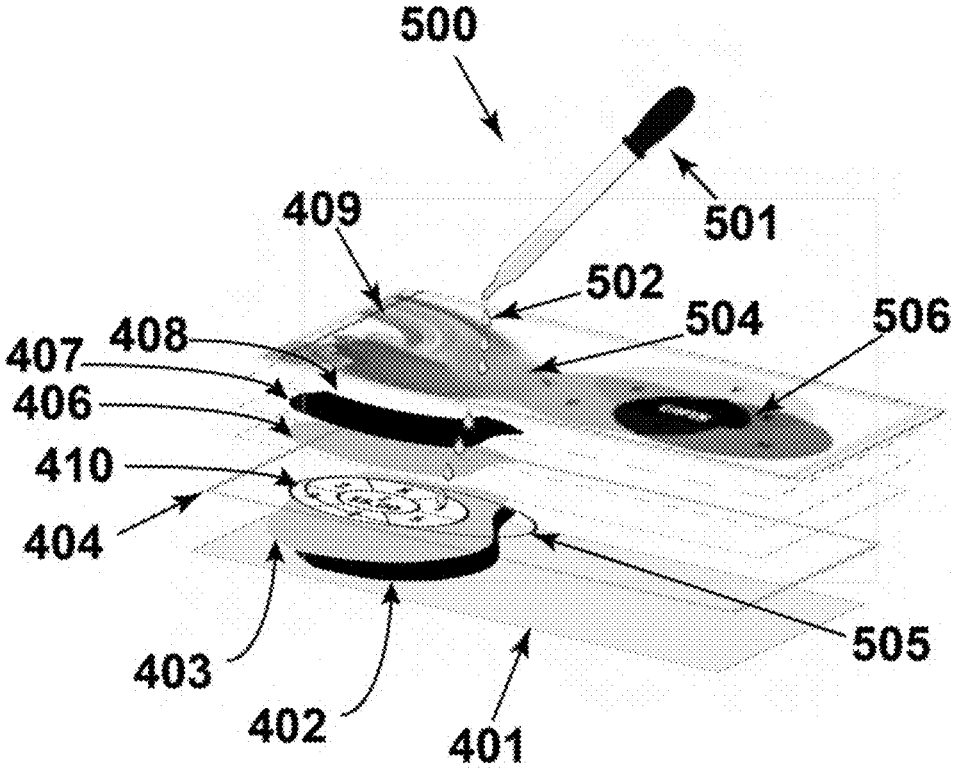
FIG. 5A is a partially exploded top isometric view of the modified lottery-type instant ticket security ink film stack of FIG. 4A utilizing variable indicia homogenized with the ticket display and overprint under a diffusion attack through the front overprint layers.

When the homogenized embodiments of the document or ticket 400, 400', and 400" of FIGS. 4A thru 4C are subjected to a diffusion attack, in various embodiments, no significant S/N of the ticket variable indicia 410 and 410' can be discerned thereby ensuring that the ticket remains secure so long as the SOC remains intact. For example, FIG. 5A depicts the homogenized embodiment of FIG. 4A under a diffusion attack 500 (FIG. 5A) through the overprint and SOC similar to FIG. 2A. With the embodiment 500 of FIG. 5A, the eyedropper 501 applies solvent 502 selected to attack the ink of the variable indicia 410. However, in the embodiment of FIG. 5A, the solvent 502 applied simultaneously attacks both the overprint area 409 as well as the variable indicia 410 resulting in a surface area 504 that dissolves and combines both the overprint area 409 and variable indicia 410. This results in a blurred image that does not carry a sufficient S/N ratio of the variable indicia ink relative to the overprint area ink to discern the variable indicia. Additionally, by having the surface overprint area 409 printed with the same materials (ink) as the variable indicia 410 any solvent sufficiently powerful to draw the variable indicia through the upper security layers 406 thru 408 would also normally irrevocably alter the overprint area 409, such that the tampering by diffusion would be readily apparent and the ticket could no longer be sold as pristine.

Figure 5B:
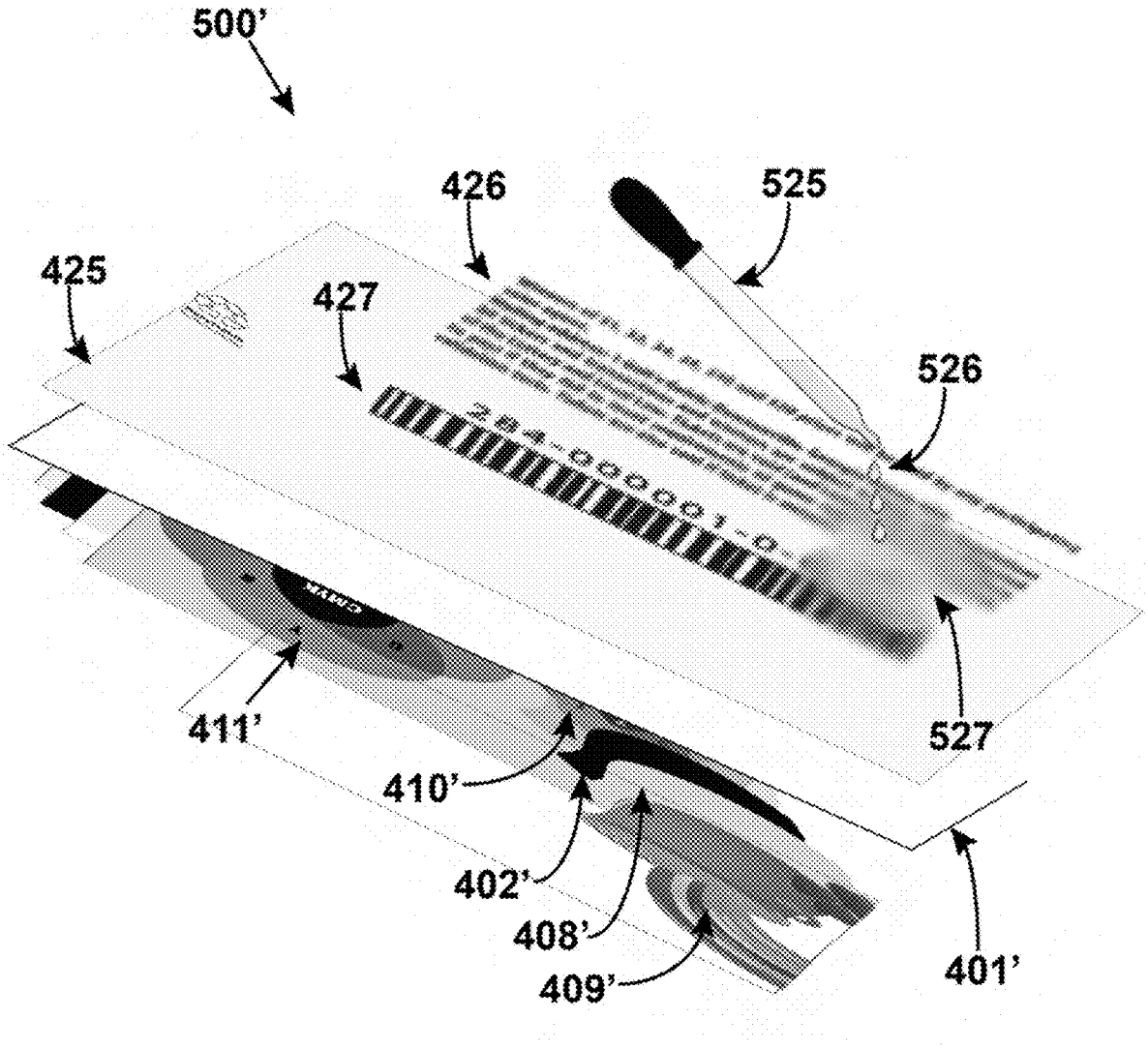
FIG. 5B is a partially exploded back isometric view of the modified lottery-type instant ticket security ink film stack of FIG. 4B utilizing variable indicia homogenized with the ticket back imaging under a diffusion attack through the back of the ticket's substrate.

When the same embodiment of the ticket 400 of FIG. 4A is subjected to tampering by diffusion from the back side of the ticket 500' as shown in FIG. 5B a similar homogeneous countermeasure result occurs 527. The legal text 426 (comprised of the same chemical composition as the variable indicia 410') that overlaps the variable indicia 410' back area of the ticket naturally responses to the diffusion attack, where a solvent 526 is gradually dispersed from an eye dropper 525, with the legal text 426 melting into whatever variable indicia 410' is diffused through the substrate 401' such that there is no appreciable S/N level derived from the variable indicia 410' with the information inherent in the variable indicia 410' not being discerned and probably the legal text itself becoming irrevocably altered such that the tampering by diffusion would be readily apparent and the ticket could no longer be sold as pristine.

Figure 5C:
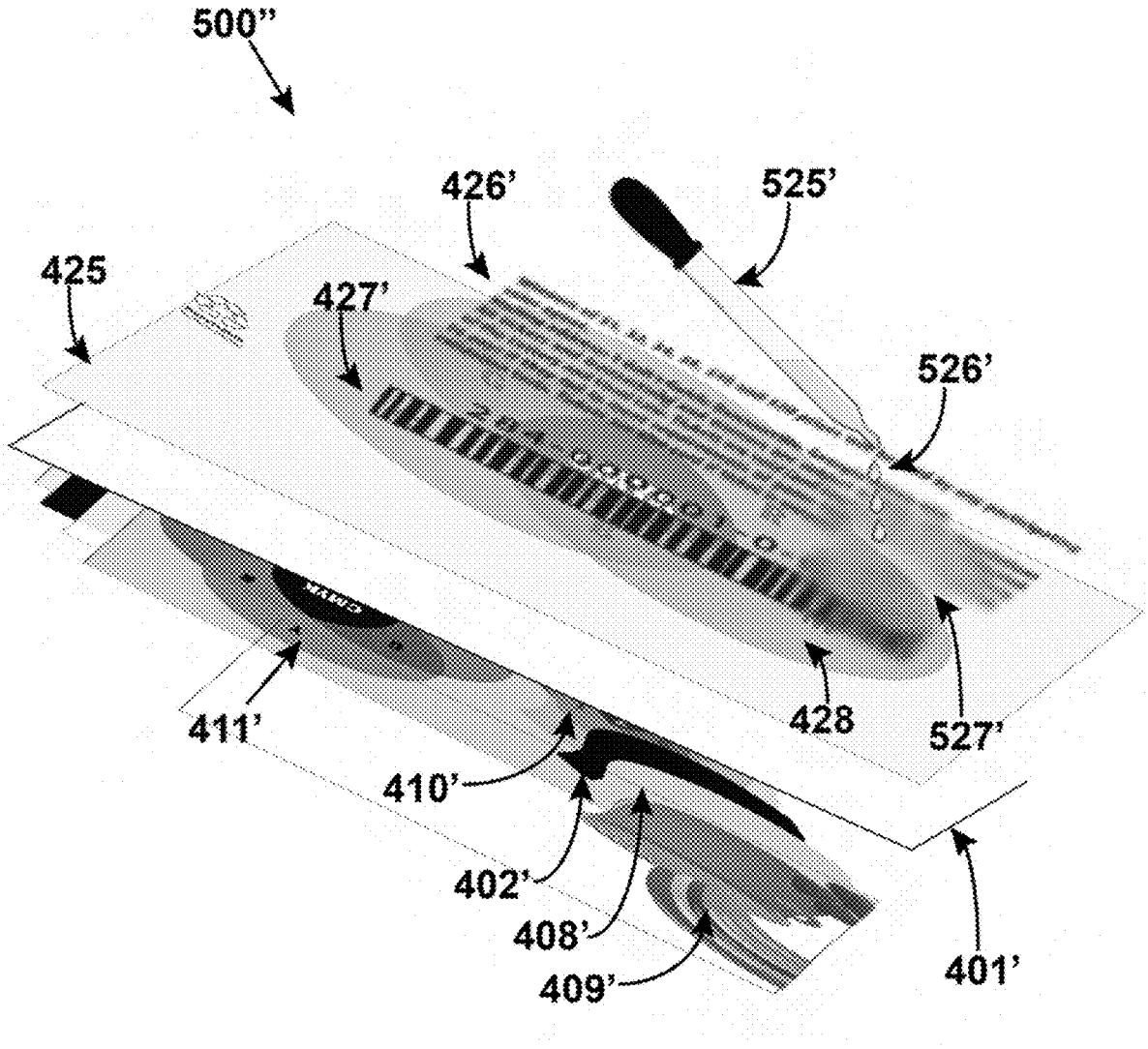
FIG. 5C is a partially exploded back isometric view of the modified lottery-type instant ticket security ink film stack of FIG. 4C utilizing variable indicia homogenized with the ticket back imaging under a diffusion attack through the back of the ticket's substrate.

With the homogenized embodiment 500" of FIG. 5C the S/N becomes even lower due to the added translucent display layer 428 comprised of the same chemical composition (ink) as the variable indicia 410' being added in addition to the legal text 426' (such as by the same application). Thus, the solvent 526' slowly dispensed from an eye dropper 525' results in an even more distorted surface 527' where there is no appreciable S/N level derived from the variable indicia 410' such that the information inherent in the variable indicia 410' cannot be discerned and again the ticket becomes irrevocably damaged.

Figure 6A:
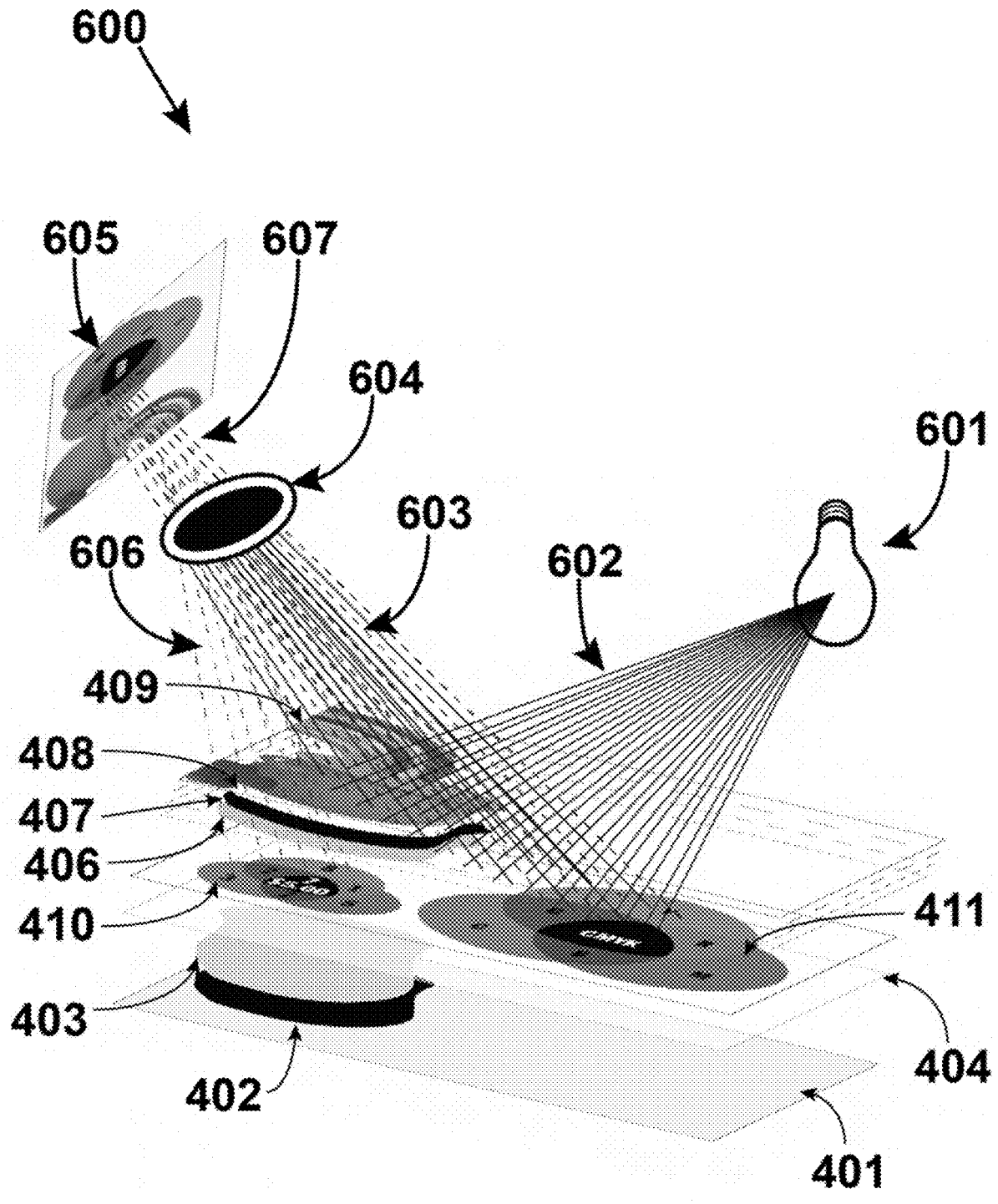
FIG. 6A is a partially exploded top isometric view of the modified lottery-type instant ticket security ink film stack of FIG. 4A utilizing variable indicia homogenized with the ticket display and overprint under a fluorescence attack through the front overprint layers.

The same principle applies when the homogenized embodiments of the ticket 400 of FIG. 4A are subjected to a fluorescence attack 600 of FIG. 6A—i.e., no appreciable S/N ratio of the ticket variable indicia 410 relative to the ticket background can be discerned. For example, FIG. 6A depicts the exemplary ticket under a fluorescence attack similar to FIG. 3B. However, in FIG. 6A an excitation light source 601 attempts to project sufficient photons of the correct excitation wavelength 602 to induce fluorescence photon emissions 606 from the variable indicia that after attenuation from passing through the upper security ink stack (406 thru 409) can be bandpass filtered 604 with sufficient intensity 607 to be detected by a timed camera exposure 605. However, in FIG. 6A the fluorescence photo emissions from the overprint 409 and/or the display 411 areas completely overwhelm any fluorescence induced photons from the variable indicia, resulting in a bandpass limited 604 time exposure image 605 that does not carry a sufficient S/N ratio of the variable indicia relative to the overprint area 409 and/or the display area 411 background noise to discern the variable indicia. Again, the common shared application of similar materials (ink) of the variable indicia with the display area 411 and the overprint area 409 results in a homogenous ticket 600 where the variable indicia cannot be picked-out due to insufficient S/N ratio.

Figure 6B:
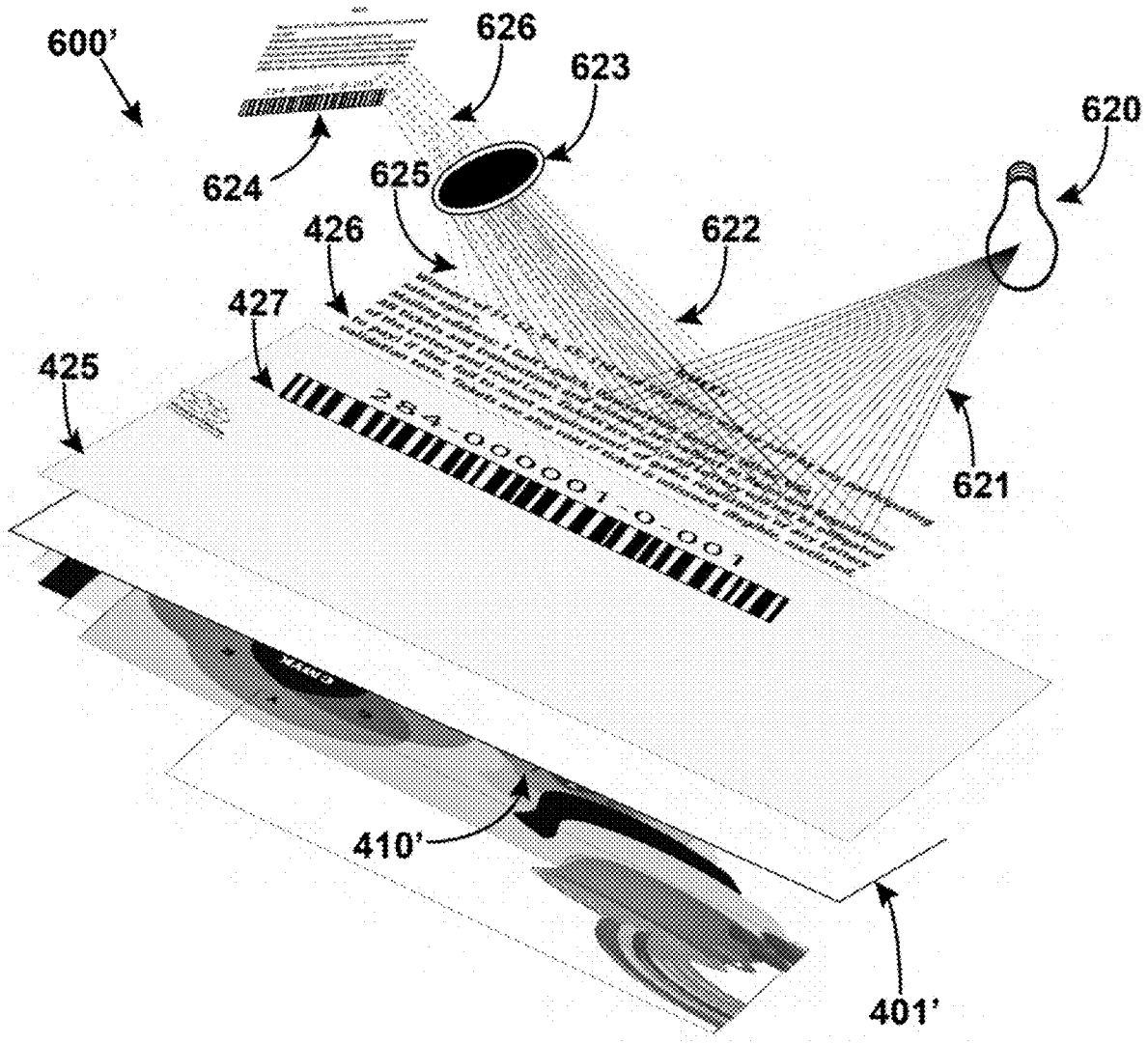
FIG. 6B is a partially exploded back isometric view of the modified lottery-type instant ticket security ink film stack of FIG. 4B utilizing variable indicia homogenized with the ticket back imaging undergoing a fluorescence attack through the back of the ticket's substrate.

When the same embodiment of the ticket 600' of FIG. 6B is subjected to a fluorescence attack 620 and 621 from the back side a similar homogeneous countermeasure result occurs 624. In this embodiment, the legal text 426 overlapping the variable indicia on the ticket's back is composed of the same chemical composition (ink) as the variable indicia 410' resulting in any emitted photons 625 from the variable indicia 410' having the same fluorescence wavelength emissions 622 as the legal text 426 such that there is no appreciable S/N level derived from the variable indicia 410' that can be discerned after bandpass filtering 623 due to the fluorescence emissions 626 of the legal text 426 completely overwhelming the emissions 625 from the variable indicia 410'.

Figure 6C:
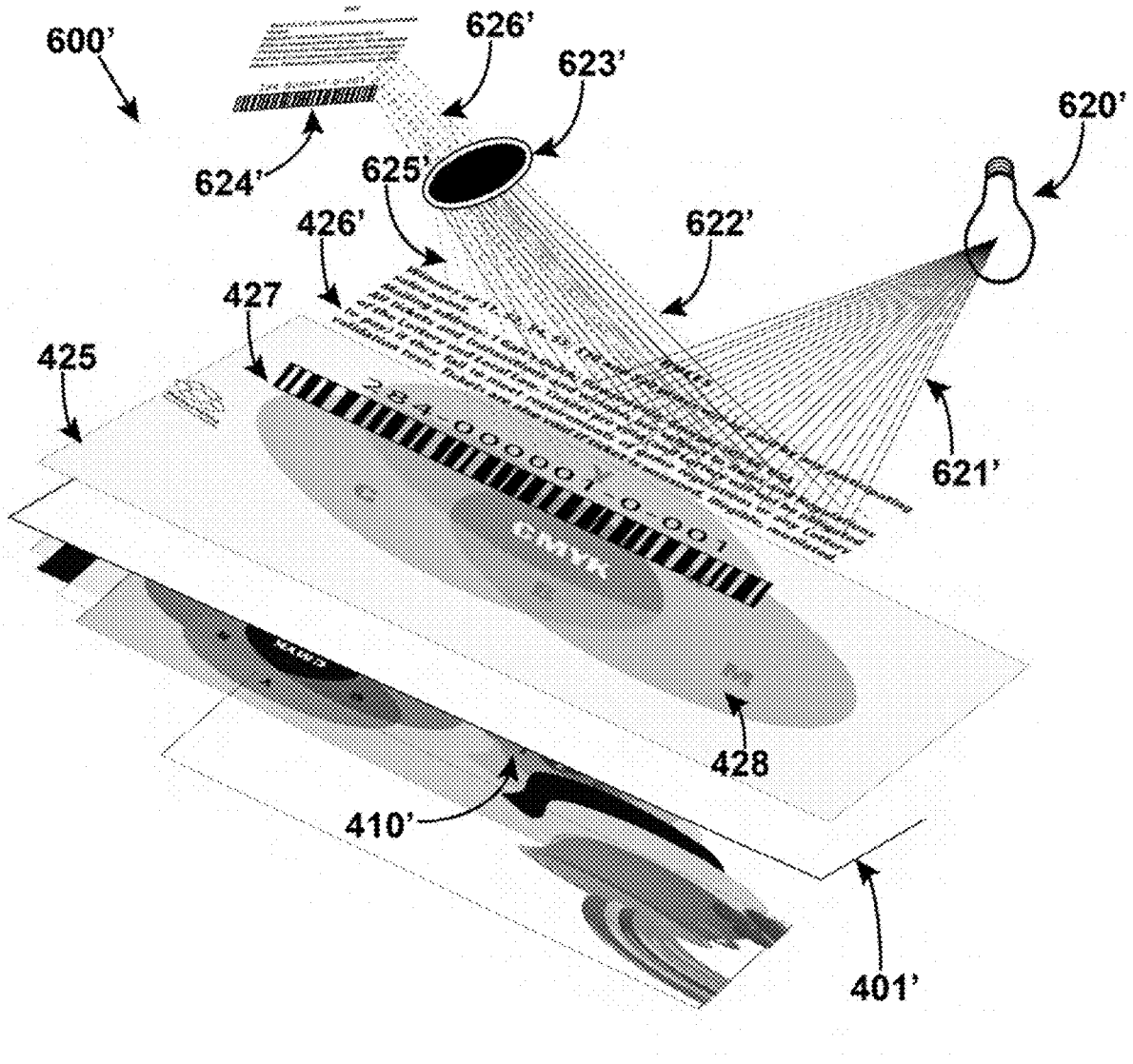
FIG. 6C is a partially exploded back isometric view of the modified lottery-type instant ticket security ink film stack of FIG. 4C utilizing variable indicia homogenized with the ticket back imaging undergoing a fluorescence attack through the back of the ticket's substrate.

With the homogenized embodiment 600" of FIG. 6C the S/N ratio becomes even lower due to the added translucent display layer 428 comprised of the same chemical composition (ink) as the variable indicia 410' being printed in addition to the legal text 426' that are subjected to a fluorescence attack 620' and 621'. Thus, again the fluorescence emissions 622' of the legal text 426' and the added translucent display layer 428 result in an even more overwhelmed captured image 624' from the bandpass limited 623' fluorescence photons 626' again resulting in no appreciable S/N level derived from the variable indicia 410' such that the information inherent in the variable indicia 410' cannot be discerned.

In various embodiments of the present disclosure, the homogenous integration of ink used in the variable indicia with the other printed portions of the document is the identical ink, so that the S/N ratio of the ink used for the variable indicia will be the same as the background ink noise of the other printed portions. Such inks may be any of a dye based ink, a pigment based ink, a toner based ink, or inks having other bases. Also in accordance with the present disclosure, the inks of the variable indicia and the other portions may be applied using the same printing technique, such as ink jet printing, thermal transfer or xerography, for instance, for the same reason. This results in the homogeneous inks of the variable indicia having no appreciable S/N ratio relative to the background ink noise of the document's at least one other printed portion, such that the variable indicia cannot be discerned so long as the SOC remains intact.

The disclosure also includes methods and systems for making a secure document as described above. In various embodiments—the method broadly comprises printing the variable indicia comprising ink having a S/N ratio relative to the background ink noise of the document's at least one other printed portion, such that the variable indicia are unreadable with reference to the at least one other printed portion when the scratch-off-coating remains intact.

Various types of printing presses and combinations of printing presses can be used to make the disclosed secure document in accordance with the present disclosure. For example, FIG. 7A illustrates one embodiment of a printing press 700 capable of producing tickets with homogenous integration of the variable indicia, the display area, the overprint area, and/or the ticket back printing area. As shown in the embodiment of FIG. 7A, paper is fed into the press on a spool 701 to a seven-color digital imaging unit 702. The seven-color unit 702 images a Lower Blocking Black (LBB) ink film layer and two white high contrast overprint ink film layers in the shape of the variable indicia scratch-off area such as with an Ultraviolet (UV) based curing system. After the lower security LBB ink film layer and the white high contrast ink film layers are applied, a four-color process digital image 702 is applied to image both the ticket variable indicia and display area. Thus, the printed ticket will have a homogenized variable indicia and display area. After printing the front variable indicia and display area the substrate is flipped and the ticket back is imaged as a four-color process by a unit 703 with application and materials identical to the process colors applied by unit 702 resulting in a homogenized ticket backing. After the ticket back is printed, the substrate is again flipped and a release coat layer is flexographic printed at a station 704 over at least the variable indicia to provide protection for the variable indicia as well as to ensure that any subsequent ink film layers deposited on the release coat will scratch-off. In various embodiments, the release coat layer is also direct energy cured with either UV or an electron beam. After the release coat layer is applied, a second seven-color unit 705 images an Upper Blocking Black (UBB) ink film layer and two white high contrast overprint ink film layers in the shape of the variable indicia scratch-off area preferably with an UV curing system. After the upper security UBB ink film layer and white high contrast ink film layers are applied, a four-color process digital image is applied to image the overprint area(s) with the same materials (inks) as the process colors applied by unit 702 resulting in a homogenized ticket overprint. Once the upper security layers and overprint layers have been imaged, periodic perforations are stamped into the substrate by a unit 706 to enable strips of tickets to be packaged and torn off individually at the time of sale. The resulting fully imaged and perforated substrate is then collected via a take-up reel or fan-folder. The embodiment of FIG. 7A has the advantage of rapid setups between press runs with the flexographic plate of the release coat at the station 704 being the only station that requires manual intervention with a possible disadvantage of low press speeds.

Another exemplary preferred press configuration capable of producing the ticket or document embodiments of FIGS. 4A, 4B, and 4C is illustrated 725 in FIG. 7B. The FIG. 7B press configuration 725 featuring three sets of process color digital imagers, one for the front display and game play variable indicia 728 (shown magnified as callout 734), a second for the back of the ticket 729 (shown magnified as callout 736), and a third process color digital imager 731 (shown magnified as callout 726) for the Overprint or "OP."

As shown in FIG. 7B, the press configuration embodiment 725 illustrates a modified hybrid flexographic and digital imager printing press used to produce variable indicia SOC secured tickets or documents that are typical in the industry. The typical industry press 725 unravels its paper web substrate from a roll 726 and flexographically prints 727 lower security layers in the scratch-off area as well as optionally primer. At this point, the press web enters a secured imager room where the front game play variable indicia are applied by imager 728. However, as disclosed herein with magnified view 734, the front game play variable indicia and display are digitally imaged as process colors with the separate Cyan 737, Magenta 738, Yellow 739, and Black 740 print heads synchronized together to produce a common process color (CMYK) display and game play variable indicia image on the front of the ticket. Imager 729 (shown magnified in 735) is utilized to digitally image CMYK process colors (741, 742, 743, and 744—respectively) on the ticket back. Next, a subsequent series of flexographic print stations 730 printing the upper security layers. At this point, a third digital imager 731 (shown magnified in 736) images a CMYK (745, 746, 747, and 748—respectively) OP on top of the SOC with fixed printing plate station 732 optionally providing a clear glossy varnish on top of the OP and/or display for added esthetics. Finally, the web would be rewound into a roll 733 for storage and ultimate processing by a separate packaging line.

The process color imagers simply represent one embodiment of this disclosure with other embodiments possible and more desirable under some circumstances. For example, high-resolution monochromatic digital imagers could be employed for the front and legal text back of the ticket instead of process color imagers, thereby resulting in a cost savings.

There are other variations of the disclosed embodiments that would be apparent in view of the present disclosure and would be within the parameters of the appended claims.

What is claimed is:

1. A security-enhanced document comprising:

a substrate;

variable indica applied to an area of a first side of the substrate, the variable indica comprising an ink comprising at least one component color of rich black ink;

a scratch-off-coating applied over the variable indicia; and digital imaging applied to an area of a reverse side of the substrate from the variable indicia, wherein the digital imaging applied to the area of the reverse side of the substrate:

is uniformly spread over the area of the reverse side of the substrate such that the digital imaging overlaps at least 50% of the variable indica applied to the area of the first side of the substrate and creates a noise barrier on the reverse side of the substrate from the variable indicia, and comprises text printed with rich black ink, wherein the text is less than 18-point font size, and wherein the text comprises words that have a mean-average word spacing of less than 0.25 inches between the words.

2. The security-enhanced document of claim 1, which is a lottery instant ticket.

3. The security-enhanced document of claim 1, wherein the ink forming the variable indicia and the rich black ink forming the digitally imaging are dye based inks.

4. The security-enhanced document of claim 1, wherein the ink forming the variable indicia and the rick black ink forming the digitally imaging are pigmented based inks.

5. The security-enhanced document of claim 1, wherein the variable indicia and digital imaging are process colors.

6. The security-enhanced document of claim 1, wherein the digital imaging comprises digitally imaged legal text.

7. The security-enhanced document of claim 1, further comprising another digitally imaged area selected from the group consisting of a display area and an overprint area.

8. The security-enhanced document of claim 1, wherein the reverse side of the substrate includes an additional homogeneous digitally imaged display portion.

9. The security-enhanced document of claim 8, wherein the additional homogeneous digitally imaged display portion is partially transparent.

10. The security-enhanced document of claim 9, wherein the partially transparent additional homogeneous digitally imaged display portion exhibits 33% opacity.

11. A security-enhanced document comprising:

a substrate having first side, an opposite second side, a top edge, a bottom edge, a first side edge, and a second side edge;

variable indica at a first area of the first side of the substrate, the first area being a first distance from the top edge and a second distance from the first side edge, the variable indica comprising an ink comprising at least one component color of rich black ink;

a scratch-off-coating applied over the variable indicia; and digital imaging at a second area of the opposite second side of the substrate, the second area being the being first distance from the top edge and the second distance from the first side edge, wherein the digital imaging:

creates a noise barrier on the opposite second side of the substrate; and comprises text printed with rich black ink, wherein the text is less than 18-point font size, and wherein the text comprises words that have a mean-average word spacing of less than 0.25 inches between words.

12. The security-enhanced document of claim 11, which is a lottery instant ticket.

13. The security-enhanced document of claim 11, wherein the ink forming the variable indicia and rich black ink forming the digital imaging are dye based inks.

14. The security-enhanced document of claim 11, wherein the ink forming the variable indicia and the rich black ink forming the digital imaging are pigmented based inks.

15. The security-enhanced document of claim 11, wherein the variable indicia and digital imaging are process colors.

16. The security-enhanced document of claim 11, wherein the digital imaging comprises digitally imaged legal text.

17. The security-enhanced document of claim 11, wherein the second side of the substrate includes an additional homogeneous digitally imaged display portion.

* * * * *